US011198304B2

(12) United States Patent
Morikawa et al.

(10) Patent No.: US 11,198,304 B2
(45) Date of Patent: Dec. 14, 2021

(54) IMAGE-RECORDING DEVICE HAVING TANK IN COMMUNICATION WITH CARTRIDGE HELD BY MOUNT BODY

(71) Applicant: Brother Kogyo Kabushiki Kaisha, Nagoya (JP)

(72) Inventors: Jun Morikawa, Nagoya (JP); Sadaaki Miyazaki, Nagoya (JP); Shinya Esaki, Nagoya (JP); Kenta Horade, Tokai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 16/857,410

(22) Filed: Apr. 24, 2020

(65) Prior Publication Data

US 2020/0338900 A1 Oct. 29, 2020

(30) Foreign Application Priority Data

Apr. 26, 2019 (JP) ..... JP2019-084939

(51) Int. Cl.
*B41J 2/175* (2006.01)
*B41J 3/46* (2006.01)

(52) U.S. Cl.
CPC ..... *B41J 2/17566* (2013.01); *B41J 2/17509* (2013.01); *B41J 2/17523* (2013.01);
(Continued)

(58) Field of Classification Search
CPC .... B41J 2/175; B41J 2/17509; B41J 2/17513; B41J 2/1752; B41J 2/17523;
(Continued)

(56) References Cited

U.S. PATENT DOCUMENTS 5,963,237 A * 10/1999 Ikkatai ..... B41J 2/1652 347/85
6,267,474 B1 * 7/2001 Mochizuki ..... B41J 2/175 347/85

(Continued)

FOREIGN PATENT DOCUMENTS

| | | |
|---|---|---|
| JP | 2011-008142 A | 1/2011 |
| JP | 2017-211679 A | 11/2017 |
| JP | 2017-213754 A | 12/2017 |

*Primary Examiner* — Anh T Vo
(74) *Attorney, Agent, or Firm* — Banner & Witcoff, Ltd.

(57) ABSTRACT

In an image-recording device, a mount body detachably holds a cartridge. The cartridge has a first chamber configured to store consumable therein. A tank is in communication with the cartridge, and the tank has a second chamber. Consumable in the first chamber is capable of moving into the second chamber. A controller determines whether a residual quantity of consumable stored in the first chamber of the cartridge held by the mount body is lower than or equal to a prescribed threshold. The controller expands, when a specific condition is satisfied, a maximum quantity of consumable up to which consumable is capable of being stored in the second chamber. The specific condition includes a first condition that the residual quantity of consumable stored in the first chamber is higher than the prescribed threshold, and a second condition that information notifying that the cartridge is to be replaced is received.

14 Claims, 16 Drawing Sheets

(52) U.S. Cl.
CPC ..... *B41J 2/17596* (2013.01); *B41J 3/46* (2013.01); *B41J 2002/17573* (2013.01); *B41J 2002/17589* (2013.01); *B41J 2202/20* (2013.01)

(58) Field of Classification Search
CPC ..... B41J 2/17526; B41J 2/17546; B41J 2/17566; B41J 2/17596; B41J 3/46; B41J 29/13; B41J 29/38; B41J 29/393; B41J 2002/17569; B41J 2002/17573; B41J 2002/17589; B41J 2202/20
See application file for complete search history.

(56) References Cited

U.S. PATENT DOCUMENTS

| | | | | |
|---|---|---|---|---|
| 6,834,945 | B2 * | 12/2004 | Ishizawa | B41J 2/17553 347/86 |
| 8,437,648 | B2 | 5/2013 | Tachibana | |
| 2003/0128256 | A1 * | 7/2003 | Oda | B41J 2/17513 347/85 |
| 2010/0329704 | A1 | 12/2010 | Tachibana | |

* cited by examiner

IMAGE-RECORDING DEVICE HAVING TANK IN COMMUNICATION WITH CARTRIDGE HELD BY MOUNT BODY

CROSS REFERENCE TO RELATED APPLICATION

This application claims priority from Japanese Patent Application No. 2019-084939 filed Apr. 26, 2019. The entire content of the priority application is incorporated herein by reference.

TECHNICAL FIELD

The present disclosure relates to an image-recording device provided with a tank for storing a consumable supplied from a cartridge that is mounted.

BACKGROUND

An image-recording device known in the art is provided with a tank, and a cartridge for storing liquid as an example of the consumable. The cartridge is mounted on the tank. The liquid in the cartridge flows from the cartridge to the tank. In this conventional image-recording device, when the cartridge runs out of liquid, a new cartridge is mounted on the tank while liquid stored in the tank is being consumed. Once the new cartridge has been mounted, liquid from the new cartridge is supplied into the tank.

SUMMARY

However, in image-recording devices that employ a detachably mounted cartridge, there is a chance that the user will replace the current cartridge while liquid still remains in the cartridge if the user is in possession of a new cartridge. For example, the user may have entered an agreement with a service provider that provides cartridges. This agreement may establish a page limit restricting the number of pages that the user can print within a prescribed time period, and the service provider may provide a new cartridge to the user at no additional charge, provided that the user has not exceeded this page limit. Under these circumstances, the service provider may provide a new cartridge to the user before the cartridge has run out of liquid. Since the user is not charged for the new cartridge, the user will not suffer any economic loss by replacing the current cartridge, which still holds liquid. However, this is not a desirable outcome, since liquid will be wasted if the user replaces the cartridge possessing residual liquid with the new cartridge and discards the old cartridge.

In view of the foregoing, it is an object of the present disclosure to provide means for reducing the likelihood that a cartridge holding residual liquid will be replaced.

In order to attain the above and other objects, the disclosure provides an image-recording device. The image-recording device includes a mount body, a tank, a recording device, a communication interface, and a controller. The mount body is configured to detachably hold a cartridge. The cartridge has a first chamber configured to store consumable therein and an outlet. The tank is configured to be in communication with the cartridge when the cartridge is held by the mount body. The tank has a second chamber configured to store consumable and an inlet. Consumable in the first chamber is capable of moving into the second chamber via the outlet of the cartridge and the inlet of the tank. The recording device is configured to record an image using consumable outputted from the second chamber. The controller is configured to perform: determining whether a residual quantity of consumable stored in the first chamber of the cartridge held by the mount body is lower than or equal to a prescribed threshold, the prescribed threshold being no less than zero; and expanding, when a specific condition is satisfied, a maximum quantity of consumable up to which consumable is capable of being stored in the second chamber, the specific condition including a first condition that the residual quantity of consumable stored in the first chamber is higher than the prescribed threshold, and a second condition that information notifying that the cartridge is to be replaced is received at the communication interface.

According to another aspect, the disclosure provides an image-recording device. The image-recording device includes a mount body, a tank, a recording device, a communication interface, and a controller. The mount body is configured to detachably hold a cartridge. The cartridge has a first chamber configured to store consumable therein and an outlet. The tank is configured to be in communication with the cartridge when the cartridge is held by the mount body. The tank has a second chamber configured to store consumable and an inlet. Consumable in the first chamber is capable of moving into the second chamber via the outlet of the cartridge and the inlet of the tank. The recording device is configured to record an image using consumable outputted from the second chamber. The controller is configured to perform: determining whether a first residual quantity of consumable stored in the first chamber is lower than or equal to a prescribed threshold, the prescribed threshold being no less than zero; and executing an expanding process to expand a maximum quantity of consumable up to which consumable is capable of being stored in the second chamber when a specific condition is satisfied, the specific condition including a first condition that the first residual quantity of consumable stored in the first chamber is higher than the prescribed threshold and a second condition that information notifying that the cartridge is to be replaced is received at the communication interface. A total residual quantity is unchanged before and after the expanding process is executed, the total residual quantity being a sum of the first residual quantity and a second residual quantity of consumable stored in the second chamber. An expanded maximum quantity to which consumable is capable of being stored in the second chamber after the expanding process is executed is larger than the maximum quantity before the expanding process is executed.

BRIEF DESCRIPTION OF THE DRAWINGS

The particular features and advantages of the disclosure as well as other objects will become apparent from the following description taken in connection with the accompanying drawings, in which.

DETAILED DESCRIPTION

Figure 1:
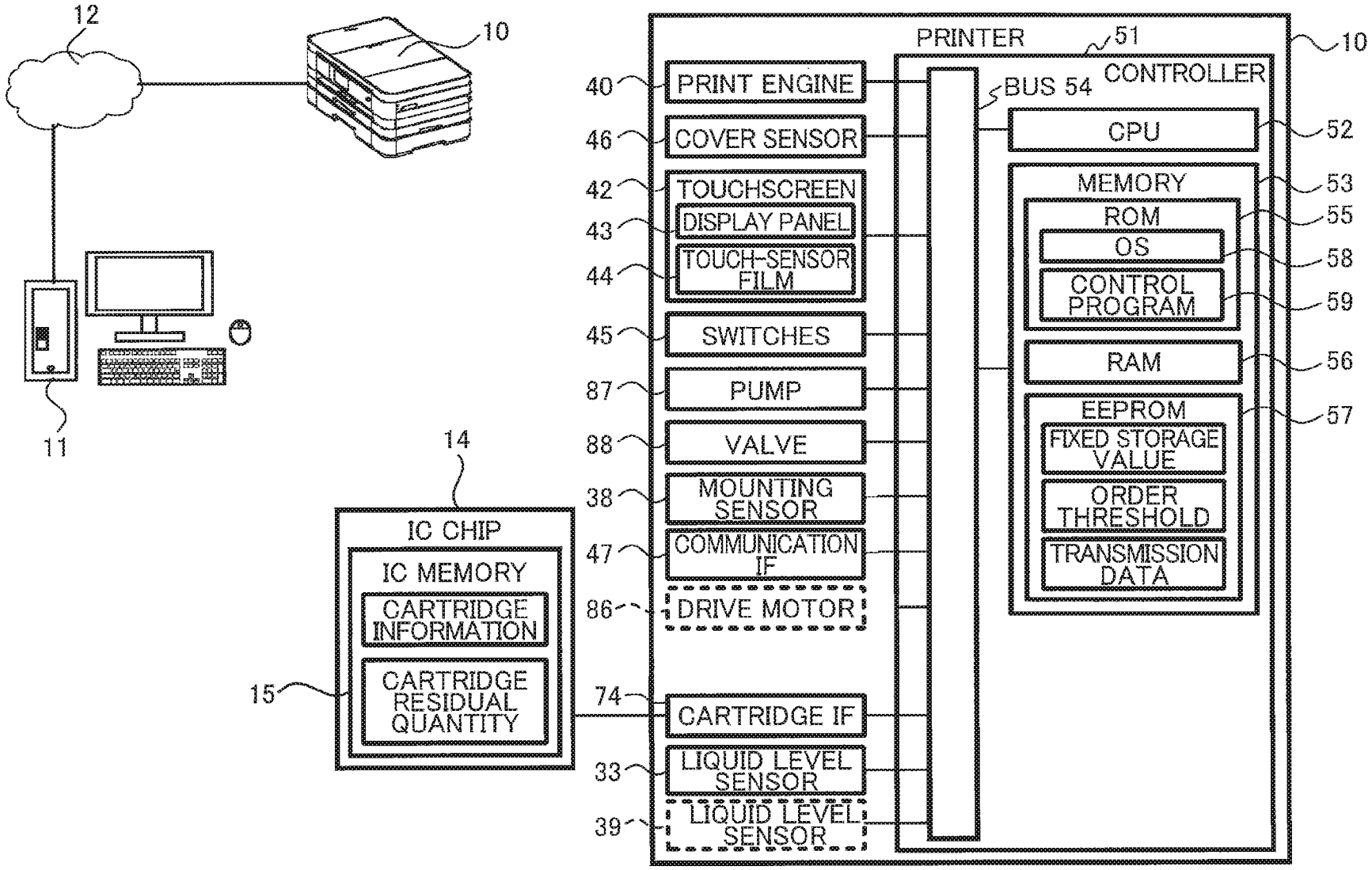
FIG. 1 is a block diagram illustrating a printer according to a first embodiment.

Next, embodiment of the present disclosure will be described while referring to the accompanying drawings. Note that the embodiment described below is merely an example of the disclosure and may be modified in many ways without departing from the scope of the disclosure, which is defined by the attached claims. Further, the order in which each of the processes described below are executed may be modified as desired without departing from the scope of the disclosure.

A printer 10 according to a first embodiment of the present disclosure will be described with reference to FIGS. 1 and 2. A service provider provides the printer 10 to a user. As shown in the left side of FIG. 1, the printer 10 is connected to an information-processing device 11 via a communication circuit 12. The communication circuit 12 includes the Internet and the like. The information-processing device 11 is a server connected to the Internet. The service provider provides the user with services, such as managing maintenance of the printer 10 and placing orders for cartridges 13 described later. For example, the service provider uses the information-processing device 11 to monitor the residual quantities of ink in cartridges 13 mounted in the printer 10 and arranges for new cartridges to be ordered based on these residual quantities.

Printer 10

As shown in FIGS. 2(A) and 2(B), the printer 10 is provided with a housing 20 and, retained in the housing 20, a panel unit 21, a cover 22, a feed tray 23, and a discharge tray 24.

The panel unit 21 is provided with a panel body 41; and a touchscreen 42 and a plurality of switches 45 retained in the panel body 41. The panel body 41 has a rectangular plate shape and is mounted on one surface of the housing 20.

In the following description, front/rear directions 8 are defined such that the side of the housing 20 on which the panel body 41 is positioned constitutes the front side, and up/down directions 7 are defined as directions in the vertical when the printer 10 is resting on a level surface. Further, left/right directions 9 are defined based on the perspective of an observer facing the front side of the printer 10. Thus, the front/rear directions 8 and left/right directions 9 correspond to horizontal directions that are both orthogonal to the up/down directions 7 and are also orthogonal to each other.

As shown in FIG. 1, the touchscreen 42 has a display panel 43 that displays images, and a clear touch-sensor film 44 superposed over the display panel 43. The touch-sensor film 44 outputs position information specifying positions on the display panel 43 that have been touched by the user. The display panel 43 and the touch-sensor film 44 of the touchscreen 42 are connected to a controller 51 described later (see FIG. 1) by a cable or the like. The controller 51 outputs image data to the display panel 43 in order to display images on the display panel 43. The controller 51 also receives position information outputted by the touch-sensor film 44. The touch-sensor film 44 and the switches 45 are an example of the input interface. The panel unit 21 may be provided with just one of the touch-sensor film 44 and the switches 45 instead of both.

Figure 2:
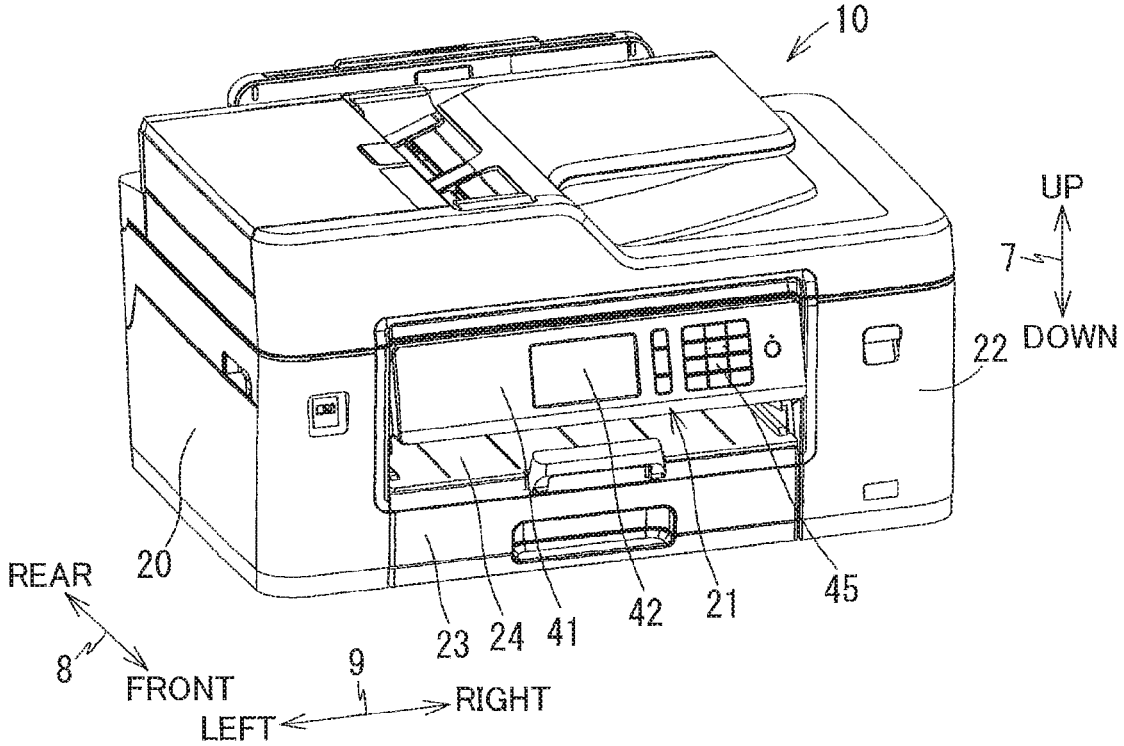
FIG. 2(A) is a perspective view of a printer according to the first embodiment, and illustrating a closed position of a cover.
FIG. 2(B) is a perspective view of the printer according to the first embodiment, and illustrating an open position of the cover.
Figure 2:
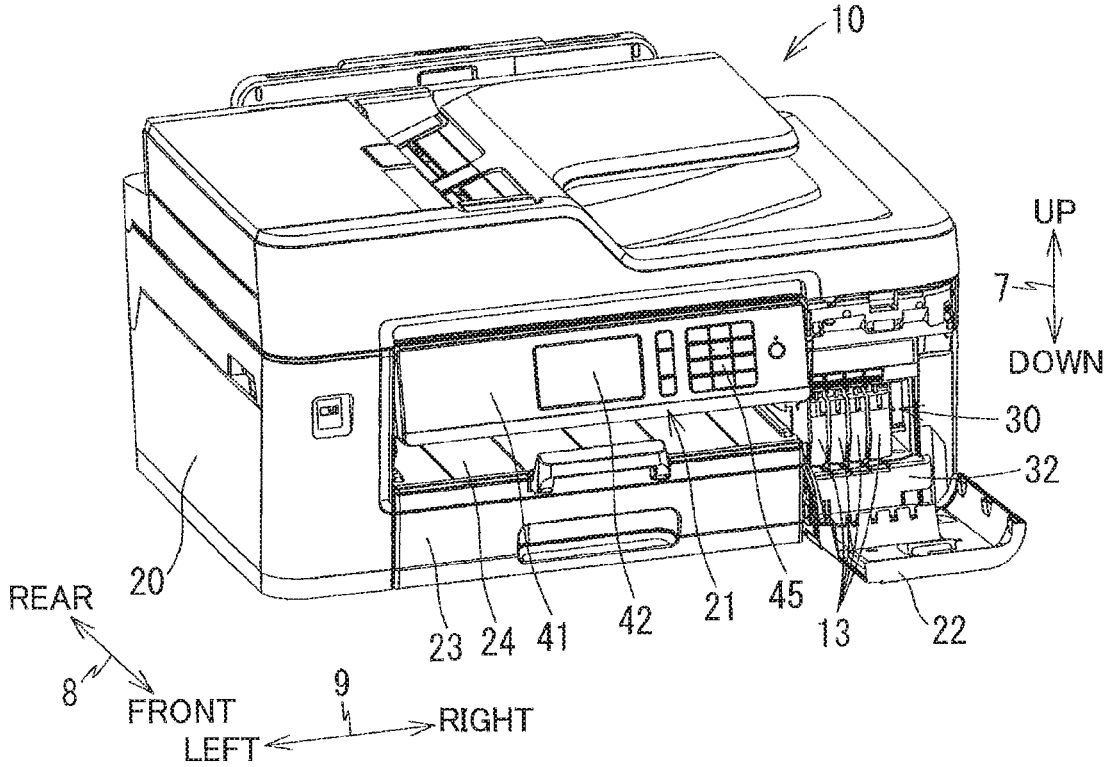

As shown in FIG. 2, the feed tray 23 is positioned in the bottom section of the housing 20 and is removably retained in the housing 20. The discharge tray 24 is positioned above the feed tray 23 in the bottom section of the housing 20 and is supported on the feed tray 23 or the housing 20.

The cover 22 is positioned on the front surface of the housing 20 at the right end thereof. The cover 22 is rotatably supported on the housing 20 and can rotate between a closed position for covering an opening formed in the right portion of the housing 20, and an open position for exposing the opening. A mounting unit 30 is disposed behind this opening and is retained in the housing 20. Cartridges 13 are detachably retained in the mounting unit 30, as will be described later in greater detail. The mounting unit 30 is an example of the mounting body.

A cover sensor 46 (see FIG. 1) is mounted in the housing 20 for detecting the opening and closing of the cover 22. The cover sensor 46 is a photo interrupter having a light-emitting diode and a photodiode, for example. The cover 22 has a detection part (not shown) positioned in the path of light emitted from the light-emitting diode when the cover 22 is in the closed position and retracted from the path of light when the cover 22 is in the open position. The cover sensor 46 outputs a different detection signal depending on whether the cover 22 is in the closed position or the open position. In the following description, the cover sensor 46 outputs a first detection signal when the cover 22 is in the closed position, and outputs a second detection signal when the cover 22 is in the open position. Note that the cover sensor 46 may be a mechanical switch, such as a tactile switch having a pressing part. In this case, the cover 22 has a protruding part in place of the detection part that presses the pressing part when the cover 22 is in the closed position.

The cover sensor 46 is connected to a controller 51 described later (see FIG. 1) by a cable or the like. The detection signal outputted by the cover sensor 46 is inputted into the controller 51. The controller 51 determines whether the cover 22 is closed or open based on whether the detection signal inputted from the cover sensor 46 is the first detection signal or the second detection signal.

Figure 3:
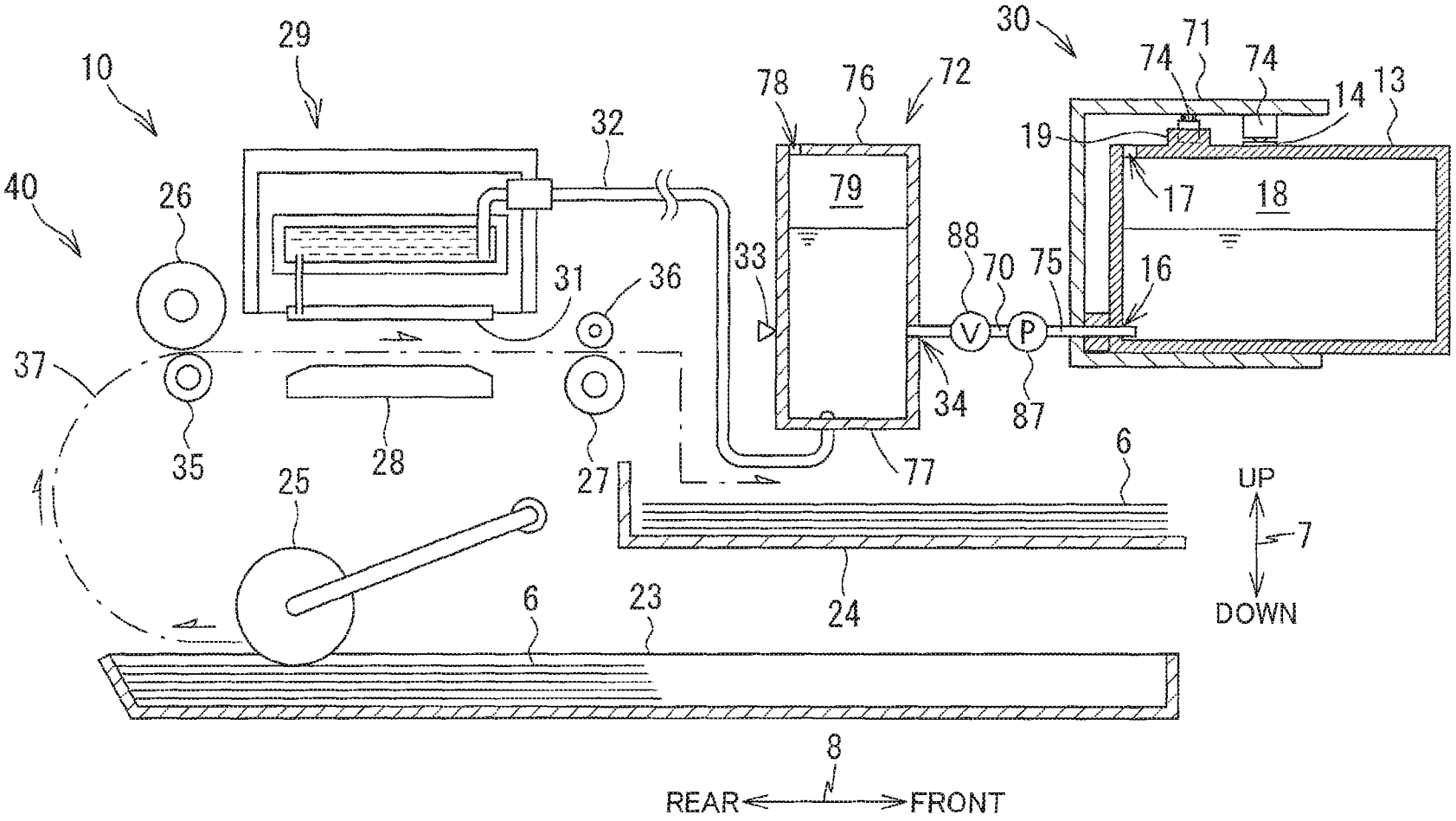
FIG. 3 is a vertical cross-sectional view schematically illustrating an internal configuration of the printer according to the first embodiment.

A print engine 40 shown in FIG. 3 is retained inside the housing 20. The print engine 40 is provided with a feed roller 25, a conveying roller 26, a discharge roller 27, a platen 28, and a recording unit 29. The feed roller 25 is retained in a frame (not shown) provided in the housing 20 and is positioned to contact a sheet 6 loaded in the feed tray 23. The feed roller 25 is rotated by a motor (not shown). When rotating, the feed roller 25 feeds a sheet 6 onto a conveying path 37. The conveying path 37 is a space defined by guide members (not shown). In the example of FIG. 3, the conveying path 37 curves upward from the rear end of the feed tray 23 to a position above the feed tray 23 and then extends forward.

The conveying roller 26 is positioned downstream of the feed tray 23 in the conveying direction of the sheets 6. The conveying roller 26 forms a roller pair with a follow roller 35. The conveying roller 26 is rotated by a motor (not shown). When rotating, the conveying roller 26 and the follow roller 35 pinch and convey a sheet 6 fed into the conveying path 37 by the feed roller 25. The discharge roller 27 is positioned downstream of the conveying roller 26 in the conveying direction of the sheets 6. The discharge roller 27 forms a roller pair with a follow roller 36. The discharge roller 27 is rotated by a motor (not shown). When rotating, the discharge roller 27 and the follow roller 36 pinch and convey the sheet 6, discharging the sheet 6 into the discharge tray 24. The platen 28 is disposed between the conveying roller 26 and the discharge roller 27 in the front/rear directions 8 at a position downstream of the conveying roller 26 and upstream of the discharge roller 27 in the conveying direction of the sheet 6.

The recording unit 29 is positioned above the platen 28. The recording unit 29 may be fixed to the frame or may be retained by guide rails constituting part of the frame so as to be capable of moving in the left/right directions 9. In other words, the printer may be a line printer or a serial printer.

The recording unit 29 possesses a head 31. Channels along which ink flows are formed inside the head 31. Each of the channels is in communication with interior space of a corresponding sub-tank 72 described later by a corresponding tube 32. In other words, ink stored in each sub-tank 72 is supplied to the head 31 of the recording unit 29 through the corresponding tube 32. The head 31 has drive elements configured of piezoelectric elements, heaters, or the like. The drive elements are provided on the channels described above. The piezoelectric elements are deformed when a DC voltage is supplied thereto, causing ink droplets to be ejected from corresponding nozzles. The nozzles are openings formed at the ends of channels. The heaters eject ink droplets from nozzles by rapidly boiling ink when a DC voltage is supplied thereto.

As shown in FIG. 3, the mounting unit 30 is provided with a mounting case 71 that is retained in the housing 20. The mounting case 71 detachably holds a plurality of cartridges 13. In the example of the drawings, the mounting case 71 detachably holds four cartridges 13. The four cartridges 13 respectively store ink in one of the colors magenta, cyan, yellow, and black, for example. In other words, the printer 10 is known as a color inkjet printer. However, the mounting case 71 may detachably hold a plurality of cartridges that accommodates toner instead of ink. In this case, the printer 10 would be a color laser printer. The ink and toner are both examples of the consumable. In the following description, a cartridge 13 and other related structures (for example, a liquid level sensor 33 and a sub-tank 72) corresponding to a color will be referred to as the cartridge 13 and the like for that color. Similarly, processes related to a certain color of ink or to structures for the certain color of ink will be described as processes for that color.

As shown in FIG. 3, one set of components is provided for each cartridge 13. Specifically, the components constituting one set includes a sub-tank 72, a pump 87, a valve 88, a liquid level sensor 33, a mounting sensor 38, a cartridge interface 74, a needle 75, and a channel member 70. In other words, four of the above sets are provided in the mounting case 71. Since the structure of each set is substantially the same, only one set will be described below.

The cartridge interface 74 is a terminal. The cartridge interface 74 is disposed at a position in the mounting case 71 for contacting electrodes (not shown) provided on a chip 14 of a corresponding cartridge 13 when the cartridge 13 is mounted in the mounting case 71. The cartridge interface 74 is connected to a controller 51 described later by a cable (not shown). Alternatively, the cartridge interface 74 may be configured of an antenna, a light-emitting diode, a photodiode, or the like. In other words, the cartridge interface 74 may exchange information or data between the chip 14 described later using radio waves or light.

The needle 75 is retained in the mounting case 71. One end of the needle 75 is inserted into an outlet 16 provided in the cartridge 13, when the cartridge 13 is mounted in the mounting case 71. In other words, an end of the needle 75 becomes positioned in the interior space of the cartridge 13 when the cartridge 13 is mounted in the mounting case 71. The opposite end of the needle 75 is connected to the pump 87. Hence, ink stored in the cartridge 13 flows out of the cartridge 13 to the pump 87 through the needle 75. Further, the needle 75 is provided near the bottom of the mounting case 71. In other words, the end of the needle 75 inserted through the outlet 16 is positioned near the inner bottom surface of the cartridge 13 when the cartridge 13 is mounted in the mounting case 71. Positioning the end of the needle 75 near the inner bottom surface of the cartridge 13 reduces the quantity of residual ink in the cartridge 13 that cannot be used for printing.

The pump 87 is a tube pump or an impeller-type pump, for example. When driven, the pump 87 transfers ink stored in the cartridge 13 to the sub-tank 72 through the channel member 70. This process will be described later in greater detail.

The pump 87 is connected to the sub-tank 72 by the channel member 70. The channel member 70 is a tube, pipe, or the like. One end of the channel member 70 is connected to the pump 87, and the opposite end is connected to the sub-tank 72.

The valve 88 is provided at a midpoint in the channel member 70. The valve 88 may be an electromagnetic valve possessing a solenoid, or a mechanical on-off valve that is opened and closed by a motor or the like. The solenoid or motor is connected to the controller 51 described later. By inputting a drive signal into the solenoid or the drive circuit of the motor, the controller 51 can open and close the valve 88. When the valve 88 is opened, the interior space of the sub-tank 72 is in communication with the interior space of the cartridge 13. In the first embodiment, the valve 88 is opened after a new cartridge 13 is mounted in the mounting case 71 and left open until a process for increasing the stored quantity of ink in the sub-tank (described later) is executed.

The sub-tank 72 is retained in the housing 20. The interior space of the sub-tank 72 constitutes a liquid chamber 79. The liquid chamber 79 stores ink. The sub-tank 72 is an example of the tank. The liquid chamber 79 is an example of the second chamber. The sub-tank 72 also has a box-like upper portion 76 that extends in the up/down directions 7 and the front/rear directions 8, and a box-like lower portion 77 that extends in the up/down directions 7 and the front/rear directions 8. The front end of the lower portion 77 is in connection with the bottom end of the upper portion 76. Further, an inlet 34 is formed in the front wall of the lower portion 77. The end of the channel member 70 connected to the sub-tank 72 is inserted into this inlet 34.

The upper portion 76 has a top wall. An air communication port 78 is formed in the top wall of the upper portion 76. The air communication port 78 provides communication between the interior and exterior of the sub-tank 72. In other words, the interior space of the sub-tank 72 is open to the atmosphere. As will be described later in greater detail, the interior space of the cartridge 13 is also open to the atmosphere. When ink is ejected from the head 31, the pressure in the interior of the tube 32 drops below atmospheric pressure. In this state, when the valve 88 is opened, the atmospheric pressure causes ink to flow from the interior of the sub-tank 72 into the tube 32. As ink flows from the sub-tank 72 into the tube 32, the level of ink stored in the sub-tank 72 drops. Consequently, atmospheric pressure causes ink stored in the cartridge 13 to flow from the cartridge 13 into the interior space of the sub-tank 72 through the needle 75 and channel member 70 until the level of ink stored in the sub-tank 72 becomes approximately equal in height to the level of ink stored in the cartridge 13.

Note that the top of the upper portion 76 is arranged at approximately the same height or higher than the top of the cartridge 13 mounted in the mounting case 71 in order to prevent ink flowing from the cartridge 13 into the sub-tank 72 from spilling out of the liquid chamber 79 through the air communication port 78.

The top of the lower portion 77 is positioned slightly higher than the vertical position of the needle 75 described above. The bottom of the lower portion 77 is positioned lower than the bottom of the cartridge 13 mounted in the mounting case 71. Therefore, the sub-tank 72 still stores ink immediately after the cartridge 13 runs out. In other words, the printer 10 can print using ink stored in the sub-tank 72, even after the cartridge 13 becomes empty. The user replaces the empty cartridge 13 with a new cartridge 13 after the cartridge 13 becomes empty and before ink stored in the sub-tank 72 is used up. Thus, providing the sub-tanks 72 reduces the chance that the printer 10 will run out of ink and become unable to print. Note that the state of the cartridge 13 when the cartridge 13 becomes empty denotes either a state in which the cartridge 13 has run completely out of ink or a state in which ink in the cartridge 13 has declined to the extent that ink no longer flows from the cartridge 13 to the sub-tank 72.

The liquid level sensor 33 is a photo interrupter having a light-emitting diode and a photodiode, for example. The light-emitting diode and the photodiode are arranged to confront the sub-tank 72 from respective left and right sides. Hence, the sub-tank 72 is positioned in the path of light emitted from the light-emitting diode. The sub-tank 72 is an article molded from a clear resin, for example, that allows passage of light. The liquid level sensor 33 outputs signals of different voltage values depending on whether ink is present or not present in the optical path. In the following description, it will be stated that the liquid level sensor 33 outputs a first detection signal when ink is present in the optical path, and outputs a second detection signal when ink is not present in the optical path. Note that the configuration of the liquid level sensor 33 is not limited to that described above. The liquid level sensor 33 may have any configuration, provided that the liquid level sensor 33 can output different detection signals according to the quantity or level of ink.

With respect to the up/down directions 7, the liquid level sensor 33 is arranged at the same height as the needle 75 described above. Thus, the detection signal outputted by the liquid level sensor 33 changes from the first detection signal to the second detection signal when the level of ink stored in the sub-tank 72 reaches the needle 75.

The liquid level sensor 33 is connected to the controller 51 by a cable or the like. The detection signal outputted by the liquid level sensor 33 is inputted into the controller 51. Based on detection signals inputted from the liquid level sensor 33, the controller 51 can determine whether the level of ink stored in the sub-tank 72 has dropped to the needle 75. In other words, based on detection signals inputted from the liquid level sensor 33, the controller 51 can determine whether the cartridge 13 has become empty.

The mounting sensor 38 is mounted on the bottom surface of the top wall configuring the mounting case 71. The mounting sensor 38 detects whether the corresponding cartridge 13 is mounted in the mounting case 71. The mounting sensor 38 is a photo interrupter configured of a light-emitting diode and a photodiode, for example. When the cartridge 13 described later is mounted in the mounting case 71, a light-blocking rib 19 provided on the cartridge 13 becomes positioned in the optical path of the mounting sensor 38. Hence, the mounting sensor 38 outputs different detection signals based on whether the cartridge 13 is mounted or not mounted in the mounting case 71. In the following description, it will be stated that the mounting sensor 38 outputs a first detection signal when the cartridge 13 is not mounted in the mounting case 71, and outputs a second detection signal when the cartridge 13 is mounted in the mounting case 71.

Each cartridge 13 has a box shape with interior space for storing ink. The interior space of the cartridge 13 for storing ink will be called a liquid chamber 18. The liquid chamber 18 is an example of the first chamber. The cartridge 13 also has an outlet 16 formed in the bottom portion of a side wall. The end of the needle 75 is inserted into the outlet 16.

An air communication port 17 is formed in the top wall of the cartridge 13. Hence, the liquid chamber 18 of the cartridge 13 is open to the atmosphere. The cartridge 13 is also provided with a chip 14. In the example of the drawings, the chip 14 is mounted on the top surface of the cartridge 13. The chip 14 has electrodes (not shown) that contact the corresponding cartridge interface 74 in the mounting case 71, and an IC memory 15 (see FIG. 1) that is electrically connected to the electrodes. Note that the chip 14 may be configured of an antenna, a light-emitting diode and a photodiode, or the like in place of the electrodes.

As shown in FIG. 1, the IC memory 15 stores cartridge information. Cartridge information may be the model number of the cartridge 13, type information, an initial residual quantity, a cartridge serial number, and the like. The type information includes information specifying a normal cartridge or a high-capacity cartridge, ink type information specifying whether the ink accommodated therein is pigment ink or dye-based ink, and color information specifying the color of the ink accommodated therein. The initial residual quantity is a value indicating the quantity of ink stored in the cartridge 13 before the cartridge 13 has been used. The cartridge serial number is identification information differentiating the cartridge 13 from other cartridges 13. The cartridge serial number is used to determine whether the cartridge 13 has been replaced. This will be described later in greater detail. Note that "cartridge" may be abbreviated as "CTG".

As shown in FIG. 1, the printer 10 is further provided with a controller 51, and a communication interface 47. The communication interface 47 is connected to the communication circuit 12. The communication circuit 12 is a local network, such as a wired or wireless local area network (LAN/WLAN) and an internet connected to the local network via a router (not shown). Drive motor 86 a liquid level sensor 39 shown in FIG. 1 will be described in a variation of the embodiment.

The controller 51 has a central processing unit (CPU) 52, a memory 53, and a communication bus 54. The CPU 52, the memory 53, the cover sensor 46, the touchscreen 42, the switches 45, the pumps 87, the valves 88, the communication interface 47, the liquid level sensors 33, the mounting sensors 38, and the cartridge interfaces 74 are all connected to the communication bus 54. Hence, the CPU 52 is connected to and capable of exchanging information, data, and signals with the memory 53, the cover sensor 46, the touchscreen 42, the switches 45, the drive motor 86, the pumps 87, the valves 88, the communication interface 47, the liquid level sensors 33, the mounting sensors 38, and the cartridge interfaces 74 via the communication bus 54. Note that a liquid level sensor 39 depicted with a dashed line in FIG. 1 is a structure included in the printer 10 according to a second embodiment described later, and is not included in the printer 10 according to the first embodiment.

The memory 53 has a ROM 55, a RAM 56, and an EEPROM 57. An operating system (OS) 58 and a control program 59 are pre-stored in the ROM 55. The CPU 52 executes commands described in the OS 58 and the control program 59. That is, the CPU 52 executes the OS 58 and the control program 59. When executed by the CPU 52, the OS 58 and the control program 59 display images on the display panel 43 and receive user input through the touch-sensor film 44 and the switches 45. The OS 58 and the control program 59 executed by the CPU 52 also exchange information and data with devices via the communication interface 47 and the cartridge interface 74, and store received information in the memory 53.

The control program 59 may be a single program or a program configured of a plurality of modules. The control program 59 has a user interface (UI) module, a communication module, and a print control module, for example. The modules are executed in a pseudo-parallel manner through multitasking. The UI module is a program that inputs image data into the display panel 43, displays images including icons and other objects on the display panel 43, and receives signals outputted by the touch-sensor film 44 and the switches 45. The communication module is a program that exchanges information and data in conformance with the communication protocol of the communication circuit to which the communication interface 47 is connected. The print control module is a program that, based on print data, generates and outputs drive signals to be inputted into the drive circuit of the motors described above or the drive circuit for drive elements possessed by the head 31.

The RAM 56 is used for executing the OS 58 and the control program 59 and for temporarily storing information or data when executing the OS 58 and the control program 59. The EEPROM 57 stores a fixed storage value, a MAC address (not shown), a serial number (not shown), an empty threshold (not shown), an order threshold, a prescribed threshold, and the like. The EEPROM 57 also stores transmission data, such as a URL for accessing a web resource published by the information-processing device 11 on the Internet. The controller 51 stores transmission data in the EEPROM 57 when the data is inputted into the printer 10. For example, the service provider may input transmission data into the printer 10 through operations on the touch-sensor film 44 or the switches 45. Alternatively, the transmission data may be inputted into the printer 10 via the communication interface 47 from a personal computer or a terminal device.

Next, processes executed by the control program 59 will be described.

These processes include a main process that the control program 59 executes to account for ink being expended during printing. The following processes executed by the control program 59 will be described as processes executed by the controller 51. In other words, the controller 51 executes the following processes according to the control program 59.

Figure 5:
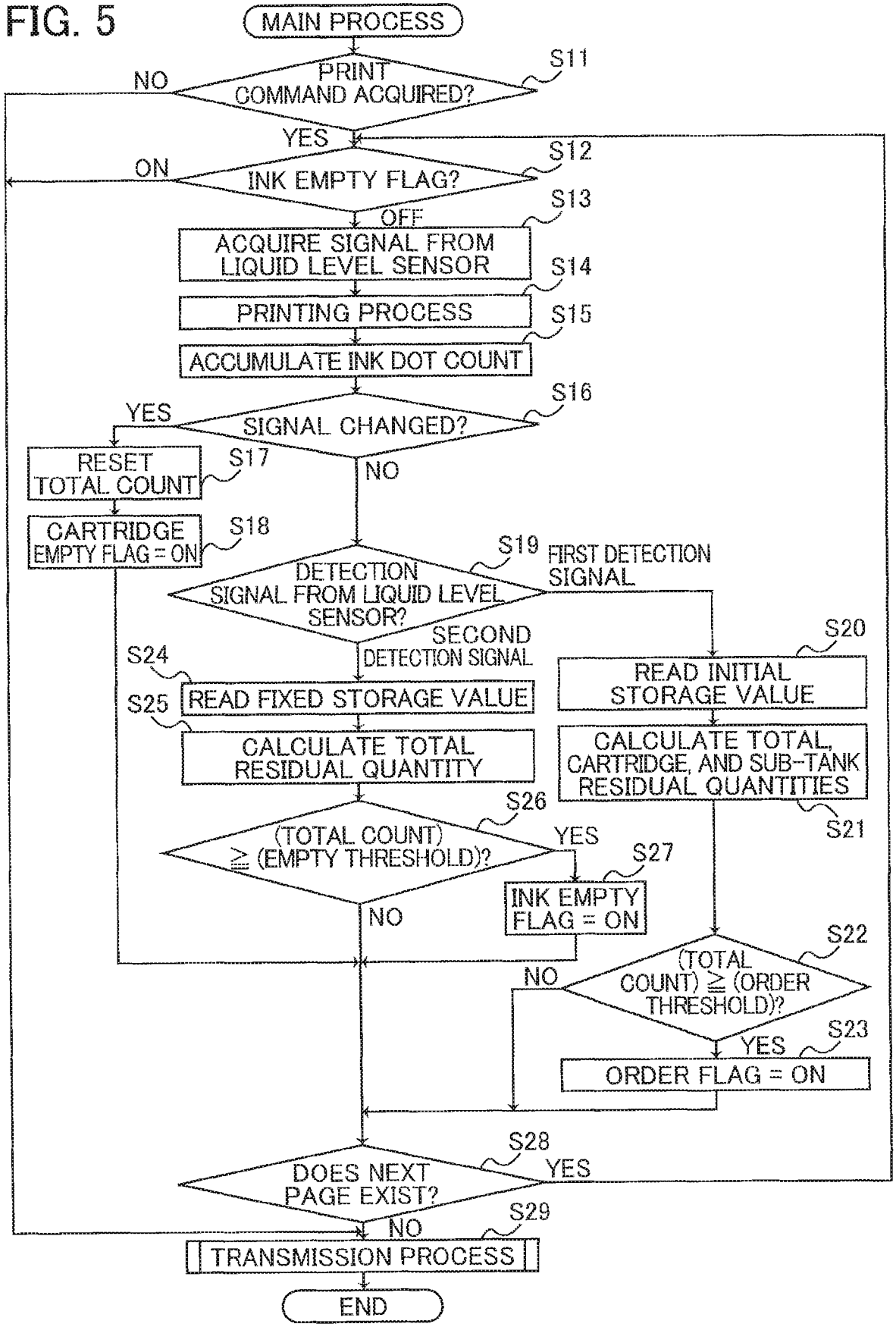
FIG. 5 is a flowchart illustrating steps in a main process executed by a controller of the printer according to the first embodiment.

The controller 51 executes the main process shown in FIG. 5. In S11 of the main process, the controller 51 determines whether a print command was acquired. A print command is inputted into the printer 10 from a personal computer via the communication circuit 12, for example. Alternatively, a print command may be inputted into the printer 10 through the touchscreen 42 or the switches 45. Although not indicated in the flowchart, print data is also inputted into the printer 10 simultaneously with the print command. Print data is inputted into the printer 10 from the personal computer described above or from removable media, such as USB memory mounted in the printer 10.

If the controller 51 determines that a print command was not acquired (S11: NO), in S29 the controller 51 executes a transmission process. The transmission process will be described later. If the controller 51 determines that a print command was acquired (S11: YES), in S12 the controller 51 determines whether an ink empty flag is set to "ON" or "OFF". The ink empty flag is a flag whose initial value is "OFF". The ink empty flag is set to "ON" in step S27 described later and is reset to "OFF" when the corresponding cartridge 13 has been replaced. The ink empty flag is set to "ON" in S27 when the controller 51 determines that the residual quantity of ink has dropped to a level at which printing cannot continue. An ink empty flag is set for each of the colors magenta, cyan, yellow, and black.

If the controller 51 determines that the ink empty flag is "ON" (S12: ON), the controller 51 executes the transmission process of S29 and subsequently ends the main process. Hence, printing is not executed when the ink empty flag is "ON" because the corresponding sub-tank 72 stores no ink. Note that the controller 51 does not execute printing when determining that even one of the ink empty flags corresponding to the ink colors magenta, cyan, yellow, and black is "ON" (S12: ON).

If the controller 51 determines that the ink empty flag is "OFF" for all colors (S12: OFF), in S13 the controller 51 acquires the detection signal outputted by the liquid level sensors 33. The detection signal that the controller 51 acquires in S13 is used later to determine whether the detection signal outputted by the liquid level sensor 33 after executing a print has changed from the detection signal outputted prior to executing the print. This process will be described later in greater detail.

In S14 the controller 51 executes a printing process. Specifically, the controller 51 generates drive signals based on the acquired print data, and outputs these drive signals. Drive signals outputted by the controller 51 are inputted into the drive circuit that drives the drive elements in the head 31 and into the drive circuits of the motors described above that rotate the feed roller 25, the conveying roller 26, and the discharge roller 27. In other words, the drive signals are outputted to convey a sheet 6, eject ink onto the conveyed sheet 6, and discharge the sheet 6 into the discharge tray 24 after an image has been recorded with the ejected ink.

While not shown in the flowchart, the controller 51 counts the number of times drive elements are driven (i.e., the number of times ink droplets are ejected) based on drive signals outputted to the drive circuit that drives the drive elements of the head 31. In the following description, the number of times that ink droplets are ejected will be called an ink dot count. The ink dot count represents the quantity of ink used in printing. Note that the controller 51 determines an ink dot count for each of the ink colors magenta, cyan, yellow, and black.

In S15 the controller 51 calculates a new value by adding the ink dot count determined in the printing process to a value stored in a prescribed memory area of the EEPROM 57 provided in the memory 53. The controller 51 then overwrites the value in the EEPROM 57 with the new value. In the following description, the value stored in the prescribed memory area of the EEPROM 57 will be called the total count. The total count is reset in step S56 of a cartridge replacement process described later (see FIG. 6(C)). Thus, the total count denotes the total quantity of ink used after a cartridge 13 was replaced. The printer 10 may also have a maintenance mechanism (not shown). This mechanism includes a pump for drawing ink from the head 31 in a maintenance operation. In such a case, the controller 51 converts the quantity of ink drawn out of the head 31 by the pump to an ink dot count and adds this ink dot count to the total count.

In S16 the controller 51 determines whether the detection signal outputted by the liquid level sensor 33 following the printing operation has changed from the signal outputted prior to the printing operation. Since a liquid level sensor 33 is provided for each color, the process beginning from S16 and ending just prior to S28 is executed for each color. Therefore, the process in S28 is executed after the process from S16 to just prior to S28 has been performed for all colors. In the following description, the color subjected to the process in steps from S16 to just prior to S28 will be called the target color. In S16 the controller 51 determines whether the level of ink has dropped to the layout position of the liquid level sensor 33 owing to ink being expended in the printing operation. Specifically, the controller 51 acquires the detection signal outputted by the liquid level sensor 33 after completion of the printing operation and compares this detection signal to the signal acquired in S13. If the controller 51 determines that the first detection signal was acquired in S13 and that the second detection signal was acquired after the printing operation (S16: YES), in S17 the controller 51 resets the total count. In other words, the controller 51 resets the total count not only when the cartridge 13 is replaced, but also when the level of ink drops to the vertical position of the liquid level sensor 33.

In S18 the controller 51 sets a cartridge empty flag to "ON". That is, the controller 51 stores the value "ON" in a prescribed memory area of the EEPROM 57 allocated for the cartridge empty flag. Note that a cartridge empty flag is set for each of the ink colors magenta, cyan, yellow, and black. Therefore, in S18 the controller 51 sets the cartridge empty flag for the target color to "ON". The controller 51 also calculates a total residual quantity, a cartridge residual quantity, and a sub-tank residual quantity for the target color, and stores these quantities in the RAM 56. The total residual quantity is a value specifying the total quantity of ink stored in the cartridge 13 and the sub-tank 72. The method of calculating the total residual quantity will be described later. The cartridge residual quantity is a value specifying the quantity of ink stored in the cartridge 13 and is set to zero in S18. The sub-tank residual quantity is a value specifying the quantity of ink stored in the sub-tank 72. In S18 the sub-tank residual quantity is set to a value equivalent to the total residual quantity since the cartridge residual quantity is now zero. After completing the process in S18, in S28 the controller 51 determines whether a next page exists. A next page is the next page for which a printing operation is to be executed. When the controller 51 determines that there is a next page (S28: YES), the controller 51 repeats the process described above from S12.

Figure 4:
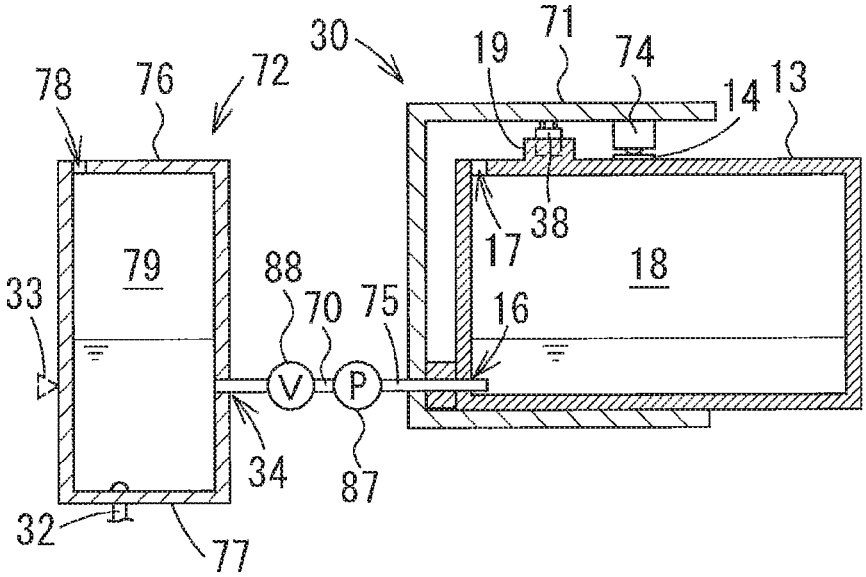
FIGS. 4(A)-4(D) are explanation diagrams illustrating operations of a pump and a valve in the printer according to the first embodiment.
Figure 4:
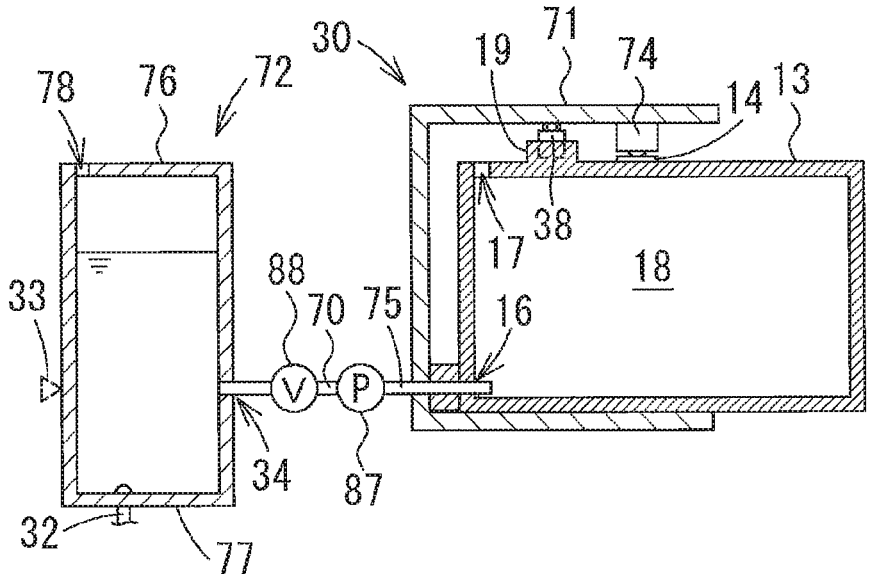
Figure 4:
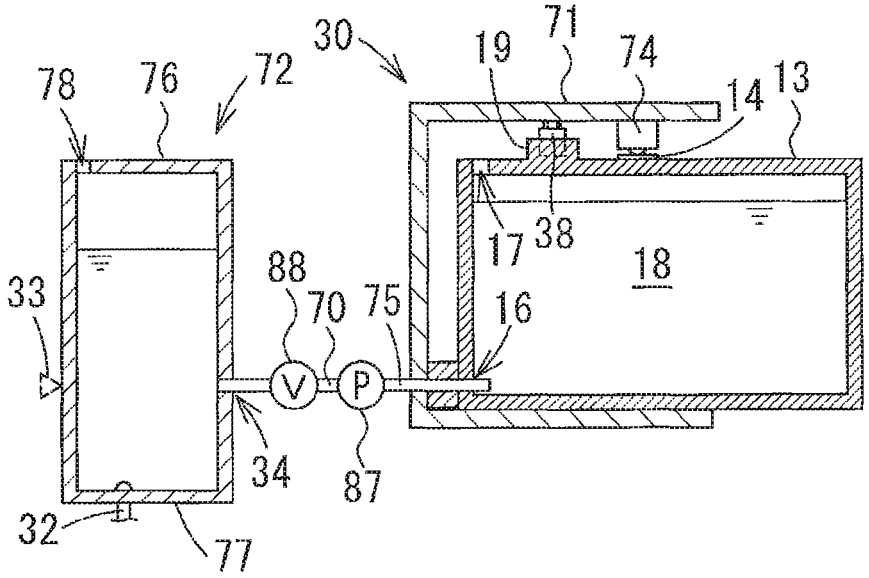
Figure 4:
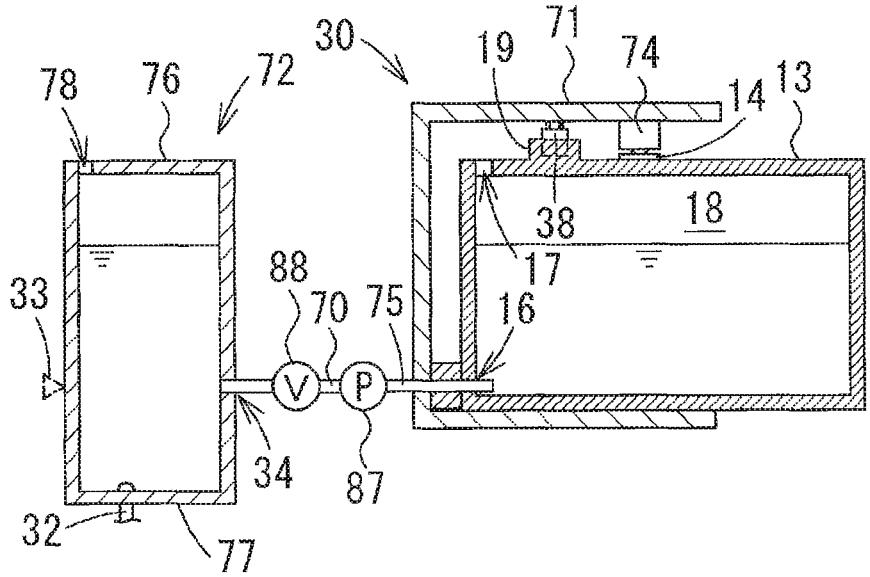

On the other hand, if the controller 51 determines in S16 that the first detection signal was acquired in S13 and the first detection signal was also acquired after the printing operation, or that the second detection signal was acquired in S13 and the second detection signal was also acquired after the printing operation (S16: NO), in S19 the controller 51 determines whether the detection signal outputted by the liquid level sensor 33 following the printing operation is the first detection signal or the second detection signal. When the controller 51 determines that the detection signal outputted by the liquid level sensor 33 after the printing operation is the first detection signal (S19: first detection signal), the controller 51 executes the process in steps S20 and S21 for calculating the residual quantity of ink. In other words, the controller 51 executes the process in S20 and S21 when ink remains in the cartridge 13, as illustrated in FIG. 4(A). More specifically, in S20 the controller 51 first reads an initial storage value from the EEPROM 57. The initial storage value is the total residual quantity calculated in S55 of the cartridge replacement process described later (see FIG. 6(C)) and stored in the EEPROM 57. Hence, the initial storage value represents the total quantity of ink stored in the cartridge 13 and sub-tank 72 immediately after a cartridge 13 is replaced. An initial storage value is stored in the EEPROM 57 for each of the ink colors magenta, cyan, yellow, and black. In S20 the controller 51 reads the initial storage value for the target color.

In S21 the controller 51 calculates the total residual quantity, the cartridge residual quantity, and the sub-tank residual quantity for the target color based on the initial storage value read in S20 and the total count stored in the EEPROM 57. The total residual quantity denotes the total quantity of ink stored in the cartridge 13 and sub-tank 72. The cartridge residual quantity denotes the quantity of ink stored in the cartridge 13. The sub-tank residual quantity denotes the quantity of ink stored in the sub-tank 72.

The process for calculating the total residual quantity, the cartridge residual quantity, and the sub-tank residual quantity will be described here in greater detail. First, the controller 51 calculates the total residual quantity by subtracting the total count from the initial storage value. Next, the controller 51 calculates the cartridge residual quantity and sub-tank residual quantity from the total residual quantity. Formulae for calculating cartridge residual quantity and sub-tank residual quantity from a total residual quantity may be pre-stored in the memory 53, for example. Hence, the controller 51 calculates the cartridge residual quantity and the sub-tank residual quantity based on the formulae stored in the memory 53 and the total residual quantity. While not shown in the flowchart, the total residual quantity, the cartridge residual quantity, and the sub-tank residual quantity calculated by the controller 51 are stored in the RAM 56 of the memory 53. The cartridge residual quantity is also stored in the IC memory 15 of the cartridge 13.

In S22 the controller 51 determines whether the total count for the target color is greater than or equal to an order threshold pre-stored in the EEPROM 57 of the memory 53. In other words, the controller 51 determines in S22 whether a new cartridge 13 must be ordered. The order threshold is set to a value equivalent to a quantity of ink that the user is anticipated to use during the period required for the service provider to arrange an order for the cartridge 13 and the period required for the shipped cartridge 13 to reach the user. Note that instead of determining whether the total count is greater than or equal to the order threshold, the controller 51 may determine in S22 whether the cartridge residual quantity or the total residual quantity calculated in S21 is less than a corresponding threshold value.

If the controller 51 determines that the total count for the target color is greater than or equal to the order threshold (S22: YES), in S23 the controller 51 sets an order flag for the target color to "ON". Specifically, the controller 51 stores the value "ON" in a prescribed memory area allocated in the EEPROM 57 for the order flag. The initial value of the order flag is "OFF". An order flag is set for each of the ink colors magenta, cyan, yellow, and black. The order flag is used for determining whether to send order information for the color corresponding to the order flag to the information-processing device 11. This process will be described later in greater detail. After completing the process in S23 or when the controller 51 determines in S22 that the total count is less than the order threshold (S22: NO), the controller 51 executes the process in S28 described above.

On the other hand, if the controller 51 determines in S19 that the liquid level sensor 33 outputted the second detection signal following the printing operation (S19: second detection signal), the controller 51 executes the process in steps S24 and S25 for calculating the residual quantity of ink. In other words, the controller 51 executes the process in S24 and S25 when the cartridge 13 is empty. More specifically, in S24 the controller 51 reads a fixed storage value from the EEPROM 57. The fixed storage value is a value pre-stored in the EEPROM 57 to denote the quantity of ink stored in the sub-tank 72 when the level of ink has dropped to the vertical position of the liquid level sensor 33. Since the sub-tanks 72 for all colors have the same configuration in the embodiment, the fixed storage value is a common value for the sub-tanks 72 of all colors. If the sub-tanks 72 varied by color, a different fixed storage value may be set for each color. In S25 the controller 51 calculates the total residual quantity for the target color by subtracting the total count for the target color stored in the EEPROM 57 from the fixed storage value read in S24. Note that the quantity of ink stored in the cartridge 13 is zero after the level of ink has reached the vertical position of the liquid level sensor 33. Therefore, the total residual quantity calculated in S25 is equivalent to the sub-tank residual quantity representing the quantity of ink stored in the sub-tank 72. While not shown in the flowchart, the controller 51 stores the total residual quantity and sub-tank residual quantity calculated in S25 in the RAM 56.

In S26 the controller 51 determines whether the total count for the target color is greater than or equal to an empty threshold. The empty threshold is a value pre-stored in the EEPROM 57. In other words, the controller 51 determines in S26 whether the total count specifying the quantity of ink used after the level of ink has dropped to the vertical position of the liquid level sensor 33 has reached the empty threshold.

Note that instead of determining whether the total count is greater than or equal to the empty threshold in S26, the controller 51 may determine whether the sub-tank residual quantity calculated in S25 is less than another empty threshold. In other words, rather than determining whether the quantity of used ink is greater than or equal to the empty threshold, the controller 51 may determine whether the residual quantity of ink stored in the sub-tank 72 is less than another empty threshold.

If the controller 51 determines that the total count is greater than or equal to the empty threshold (S26: YES), in S27 the controller 51 sets the ink empty flag for the target color to "ON". That is, the controller 51 stores the value "ON" in a prescribed memory area of the EEPROM 57 allocated for the ink empty flag. An ink empty flag is provided for each of the ink colors magenta, cyan, yellow, and black. The controller 51 skips S27 when the total amount is less than the empty threshold (S26: NO).

After completing one of the processes of S18, S23, S22: NO S27, and S26: NO for each color, in S28 the controller 51 determines whether a next page exists. If the controller 51 determines that a next page exists (S28: YES), the controller 51 repeats the process described above from S12. However, if the controller 51 determines that a next page does not exist (S28: NO), in S29 the controller 51 executes the transmission process for transmitting management information described below to the information-processing device 11.

The transmission process of S29 will be described next with reference to FIG. 6(A). Note that steps S31 through S35 in the transmission process are executed for each of the four cartridges 13, i.e., for each of the four colors. Hence, the flags referenced in the description of S31-S35 denote flags for the current target color. After completing the process in S31-S35 for all colors, the controller 51 executes the process beginning from S36.

In S31 at the beginning of the transmission process, the controller 51 determines whether the ink empty flag is set to "ON" or "OFF". If the controller 51 determines that the ink empty flag is "ON" (S31: ON), in S32 the controller 51 includes ink empty information in the management information that indicates the printer 10 is out of ink. If the controller 51 determines that the ink empty flag is "OFF" (S31: OFF), the controller 51 skips step S32.

In S33 the controller 51 determines whether the order flag is set to "ON" or "OFF". In other words, the controller 51 determines in S33 whether a new cartridge 13 should be ordered. If the controller 51 determines that the order flag is "OFF" (S33: OFF), the controller 51 skips the process in steps S34 and S35 described below. When the controller 51 determines that the order flag for the current target color is "ON" (S33: ON), in S34 the controller 51 determines whether an on-order flag is "ON" or "OFF". The initial value for the on-order flag is "OFF". The on-order flag is set to "ON" when order information has been sent to the information-processing device 11 and is reset to "OFF" when the cartridge 13 is replaced. In other words, the on-order flag is provided to prevent duplicate order information from being sent to the information-processing device 11. An on-order flag is set for each of the ink colors magenta, cyan, yellow, and black.

If the controller 51 determines that the on-order flag is "OFF", indicating that order information has not been sent to the information-processing device 11 (S34: OFF), in S35 the controller 51 includes order information in the management information. Order information includes the model number of the cartridge 13 that must be ordered, for example. That is, the order information has information specifying the current target color (hereinafter called "color information"). If the controller 51 determines that the on-order flag is "ON", indicating that order information has already been sent to the information-processing device 11 (S34: ON), the controller 51 skips step S35.

While not indicated in the flowchart, the controller 51 includes other information in the management information, such as the cartridge residual quantity, sub-tank residual quantity, and total residual quantity.

In S36 the controller 51 transmits the management information generated in the previous steps through the communication interface 47 addressed to the information-processing device 11 indicated in the transmission data stored in the EEPROM 57. Specifically, the controller 51 sends an HTTP request that includes the management information to the information-processing device 11. In S37 the controller 51 determines whether an ACK (acknowledgment) was received from the information-processing device 11 indicating that the information-processing device 11 received the management information. If the controller 51 determines that an ACK was not received (S37: NO), the controller 51 repeatedly attempts to resend the management information. When the management information includes order information, the information-processing device 11 returns an ACK that includes on-order information indicating that the service provider has placed an order for the cartridge 13. The on-order information indicates that order information including color information was received. In other words, on-order information includes the same color information as the color information included in the order information. If the controller 51 determines that an ACK including on-order information was received (S37: YES), in S38 the controller 51 sets the on-order flag to "ON" for each color represented by the color information included in the on-order information, and subsequently ends the transmission process. Note that though not shown in the flowchart in detail, if the ACK does not include on-order information, i.e., when order information was not included in the management information sent by the controller 51 in S36, the controller 51 skips the process in S38. Hence, the on-order flag is not changed in this case.

Figure 7:
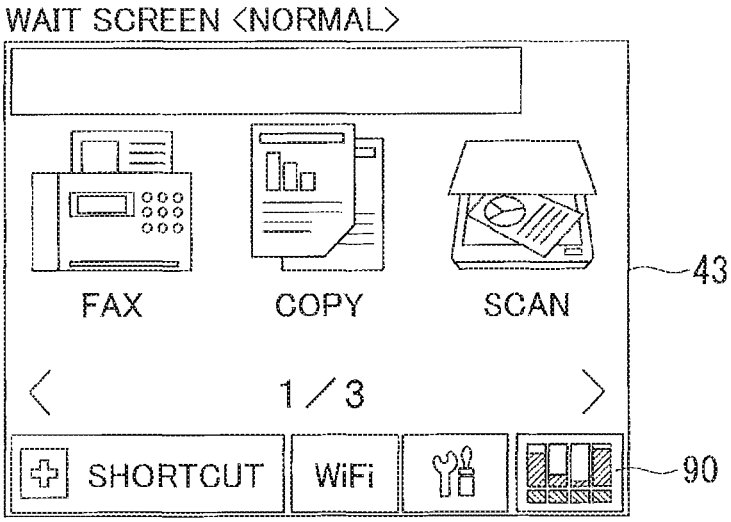
FIGS. 7(A)-7(C) are explanatory diagrams illustrating a wait screen displayed on the printer according to the first embodiment.
Figure 7:
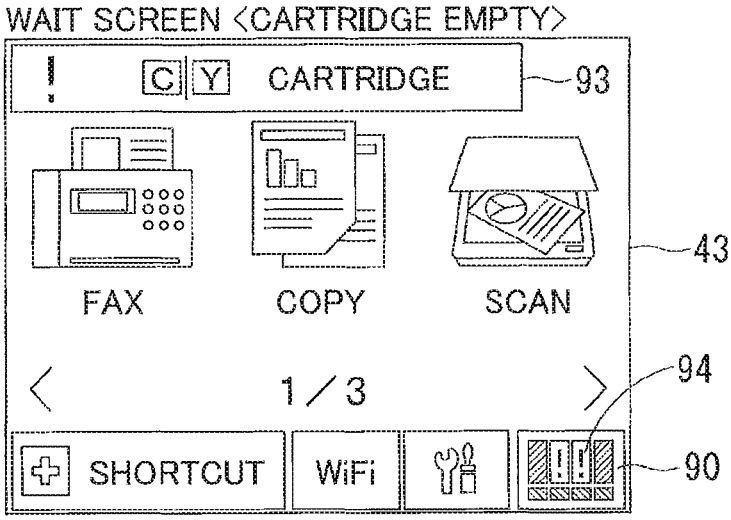
Figure 7:
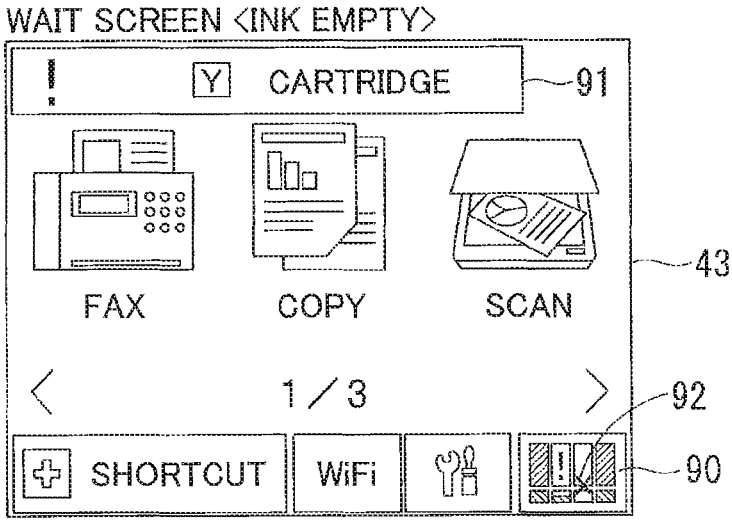
Figure 8:
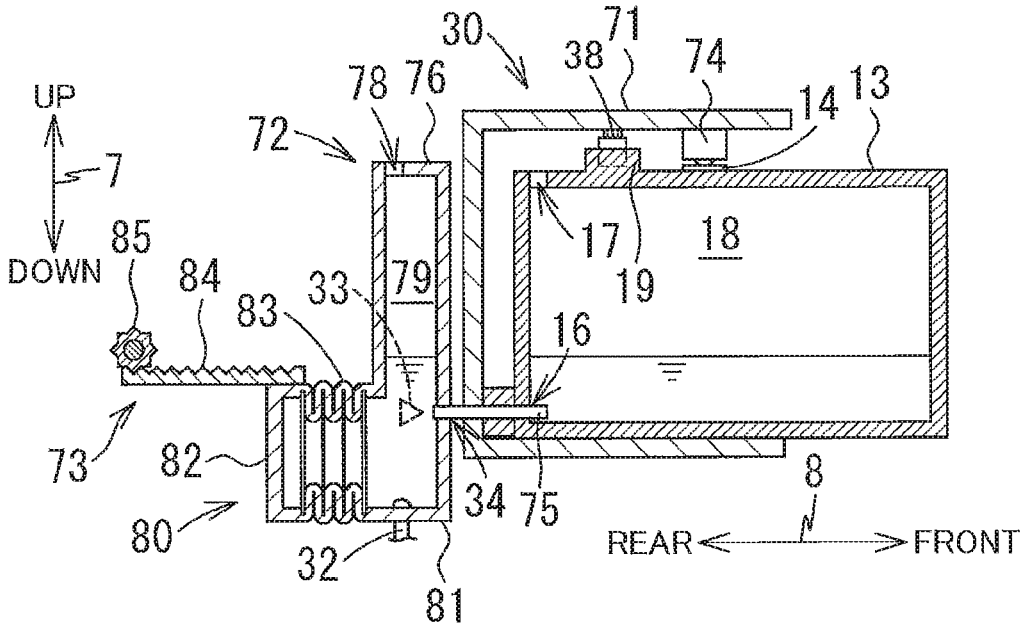
FIGS. 8(A)-8(D) are explanatory diagrams illustrating operations of a sliding device in a printer according to a first variation of the first embodiment.
Figure 8:
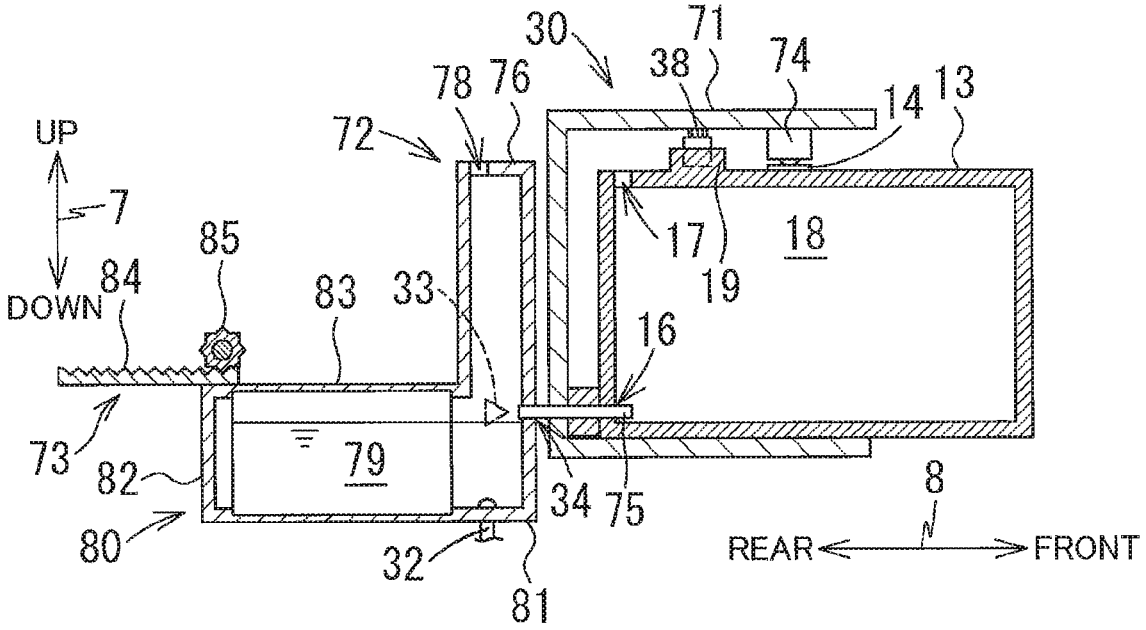
Figure 8:
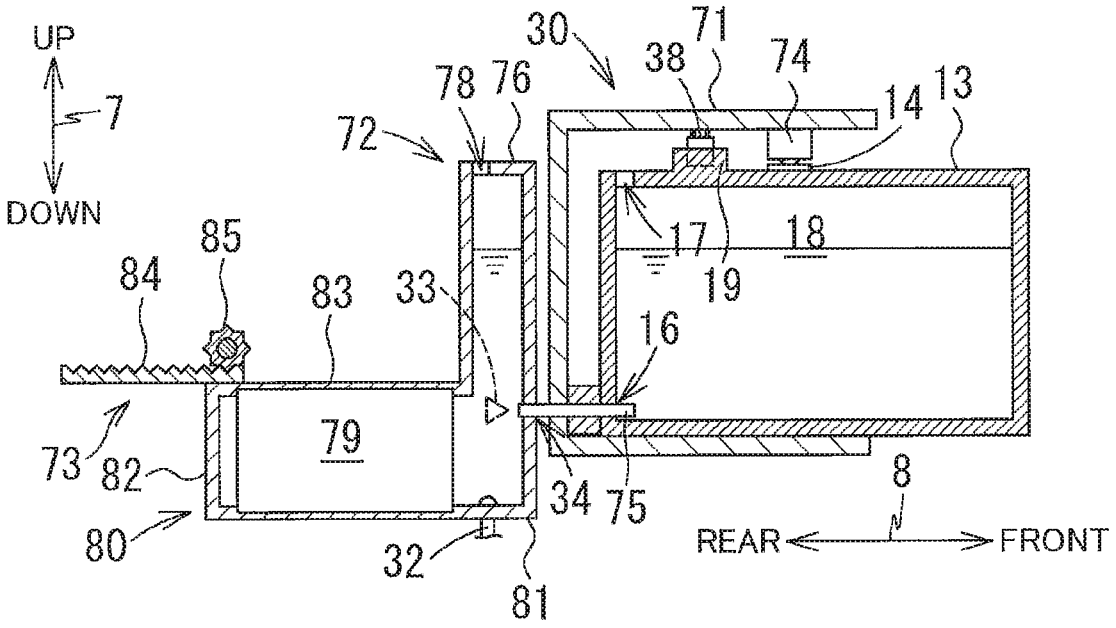
Figure 8:
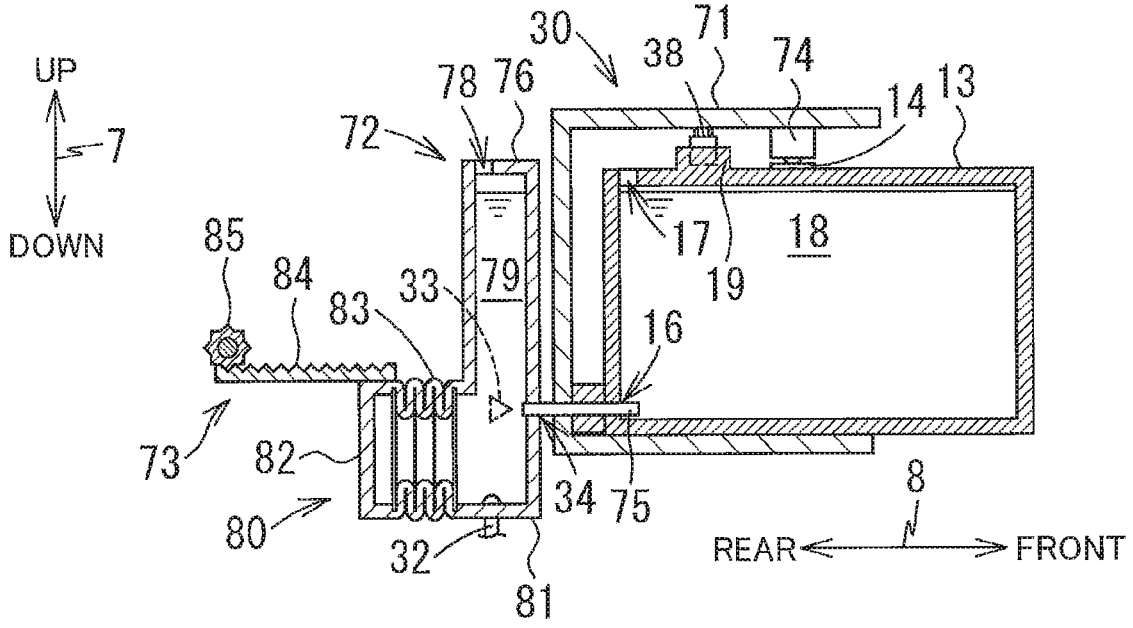

While not indicated in the flowchart, the controller 51 displays a wait screen, such as that shown in FIGS. 7(A)-7(C), on the display panel 43 based on the values set for the ink empty flags and the cartridge empty flags and the calculated cartridge residual quantity and sub-tank residual quantity.

FIG. 7(A) shows an example of a wait screen displayed on the display panel 43 when both the ink empty flag and the cartridge empty flag for all colors are set to "OFF". The wait screen in the example of FIG. 7(A) has a plurality of icons that include a Fax icon, a Copy icon, a Scan icon, and an ink icon 90. The ink icon 90 graphically depicts the residual quantities of ink. Specifically, the ink icon 90 has four sets of vertical bars juxtaposed in the left-right direction. From left to right, the sets of bars represent residual quantities of ink for the colors magenta, cyan, yellow, and black. Each set of bars is configured of two bars juxtaposed vertically. The top bar represents the residual quantity of ink in the corresponding cartridge 13, and the bottom bar represents the residual quantity of ink in the corresponding sub-tank 72. Residual quantities of ink in the cartridges 13 and sub-tanks 72 depicted in FIGS. 7(A)-7(C) are based on the values calculated in steps S21 and S25 described above and stored in the RAM 56.

The wait screen shown in FIG. 7(B) is displayed on the display panel 43 when the ink empty flag is "OFF" for all colors, the cartridge empty flag is "ON" for cyan and yellow, and the cartridge empty flag is "OFF" for magenta and black. The wait screen in FIG. 7(B) includes an alert message 93 and "!" objects 94 in addition to the icons described above. The "!" objects 94 are displayed over sets of bars in the ink icon 90 that represent empty cartridges 13. In this example, a "!" object 94 is displayed over the second set of bars from the right representing yellow ink and over the second set of bars from the left representing cyan ink. The alert message 93 includes a "!" character, characters representing colors of ink, and the character string "Cartridge." In this example, "C" and "Y" are displayed as the characters representing ink colors, where "C" represents cyan and "Y" represents yellow.

The wait screen shown in FIG. 7(C) is displayed on the display panel 43 when both the ink empty flag and the cartridge empty flag for yellow are set to "ON", the ink empty flag for cyan is set to "OFF", the cartridge empty flag for cyan is set to "ON", and both the ink empty flag and the cartridge empty flag for the remaining colors magenta and black are set to "OFF". The wait screen in FIG. 7(C) has an alert message 91 and a "x" object 92 in addition to the icons shown in FIG. 7(A). The "x" object 92 is displayed over sets of bars in the ink icon 90 corresponding to colors of ink that have been depleted. In this example, the "x" object 92 is displayed over the second set of bars from the right representing the residual quantity of yellow ink. The alert message 91 includes a "!" character, characters representing ink colors, and the character string "Cartridge." Because the ink empty flag is set to "ON" in addition to the cartridge empty flag for yellow, the character string "Sub-tank" may be displayed in addition to or instead of "Cartridge". In this example, "Y" is displayed as the character representing an ink color, and specifically represents yellow. Based on the "x" object 92 and the alert message 91 in this example, the user can recognize that the printer 10 has run out of yellow ink. Because the cartridge empty flags for yellow and cyan are "ON", "C" may be displayed together with "Y".

Next, a replacement notification process executed by the controller 51 will be described with reference to FIG. 6(B). The controller 51 executes the replacement notification process periodically, for example. The process is executed for each color. In S41 at the beginning of the replacement notification process, the controller 51 determines whether a replacement notice was acquired. A replacement notice may be information specifying that a cartridge 13 was ordered. For example, the replacement notice may be on-order information included in the ACK described above. Therefore, a replacement notice, like on-order information, will include color information. Alternatively, when the service provider has shipped a cartridge 13, the replacement notice may be information inputted into the printer 10 from the information-processing device 11 or inputted into the printer 10 through the touch-sensor film 44 and the switches 45. In this case, information similar to the color information included in on-order information is inputted. The replacement notice is an example of information used to notify a user that a cartridge is to be replaced.

If the controller 51 determines that a replacement notice was not acquired or that the acquired replacement notice does not include color information for the color being targeted in the current process (S41: NO), the controller 51 ends the replacement notification process. However, if the controller 51 determines that a replacement notice that includes color information for the color targeted in the current process has been acquired (S41: YES), in S42 the controller 51 determines whether the cartridge residual quantity for the cartridge 13 specified in the replacement notice is greater than zero. In other words, if a cartridge 13 has been ordered, indicating that the cartridge 13 of the same color is to be replaced soon, in S42 the controller 51 determines whether the cartridge 13 being replaced by the cartridge 13 on order still holds some ink. Note that the cartridge residual quantity used in S42 is the value calculated in S21 or S18 and stored in the RAM 56.

If the controller 51 determines that the cartridge residual quantity is not greater than zero (i.e., that the value is zero; S42: NO), the controller 51 ends the replacement notification process. However, if the controller 51 determines that the cartridge residual quantity is greater than zero (i.e., that the value is not zero; S42: YES), in S43 the controller 51 executes a process to increase the quantity of ink stored in the sub-tank. Specifically, the controller 51 drives the pump 87 corresponding to the cartridge 13 being replaced for a prescribed time, and subsequently closes the opened valve 88. The controller 51 calculates the prescribed time as a sufficient time for moving the entire quantity of ink specified by the cartridge residual quantity from the cartridge 13 to the sub-tank 72, for example. Setting this prescribed time as the initial value for a timer count, the controller 51 begins counting down the timer count while driving the pump 87. The controller 51 stops driving the pump 87 when the timer count reaches zero. Through the process of S43, the controller 51 forcibly moves all ink stored in the cartridge 13 being replaced to the sub-tank 72, as illustrated in FIG. 4(B). Since the valve 88 is subsequently closed and maintained in this closed state, the ink cannot return to the cartridge 13 from the sub-tank 72. The process of S43 is one example for expanding a maximum quantity of consumable to which the sub-tank 72 is allowed to store consumable.

Having executed the process to increase the stored quantity of ink in the sub-tank, in S44 the controller 51 executes an alerting process. In the alerting process, the controller 51 displays the "!" object 94 in the wait screen over the bar in the ink icon 90 representing the ink stored in the cartridge 13 that was just emptied by driving the corresponding pump 87. The controller 51 also displays the alert message 93 described above in the display panel 43 in this alerting process. The alert message 93 includes a character or the like representing the color of ink stored in the cartridge 13 that was just emptied by driving the pump 87. The alert message 93 and "!" object 94 are examples of alerts.

Next, a cartridge replacement process executed by the controller 51 when the user replaces a cartridge 13 will be described with reference to FIG. 6(C). For example, the cartridge replacement process is executed for each color selected by the user (target color). In this case, the cartridge 13 to be replaced is the cartridge 13 of the target color.

The controller 51 periodically executes the cartridge replacement process, for example. In S51 at the beginning of the process, the controller 51 determines whether the cover 22 was opened in order to replace a cartridge 13. Specifically, the controller 51 determines whether the signal inputted from the cover sensor 46 is the second detection signal. If the controller 51 determines that the inputted signal from the cover sensor 46 is the first detection signal, indicating that the cover 22 was not opened (S51: first detection signal), the controller 51 ends the cartridge replacement process.

However, if the controller 51 determines that the signal inputted from the cover sensor 46 is the second detection signal, indicating that the cover 22 was opened (S51: second detection signal), in S52 the controller 51 determines whether the detection signal outputted by the mounting sensor 38 changed from the second detection signal to the first detection signal and subsequently changed again to the second detection signal. In other words, in S52 the controller 51 determines whether the used cartridge 13 was removed from the mounting case 71 and a new cartridge 13 was mounted in the mounting case 71. If the detection signal outputted from the mounting sensor 38 remains at the second detection signal (S52: NO) and subsequently the cover sensor 46 outputs the first detection signal, the controller 51 ends the cartridge replacement process.

However, if the controller 51 determines that the detection signal outputted by the mounting sensor 38 first changes from the second detection signal to the first detection signal and the changes back to the second detection signal (S52: YES), in S53 the controller 51 determines whether the cartridge serial number matches the previous number. Specifically, the controller 51 reads the cartridge serial number from the IC memory 15 on the cartridge 13 mounted in the mounting case 71 through the cartridge interface 74. Next, the controller 51 determines whether the cartridge serial number read from the IC memory 15 matches the cartridge serial number previously stored in the EEPROM 57 of the memory 53 before the cartridge was replaced. The cartridge serial numbers will match if the cartridge 13 removed from the mounting case 71 is remounted in the mounting case 71. The controller 51 stores the read cartridge serial number in the EEPROM 57.

If the controller 51 determines that the cartridge serial numbers match (S53: YES), the controller 51 ends the cartridge replacement process when the cover sensor 46 subsequently outputs the first detection signal. However, if the controller 51 determines that the cartridge serial numbers do not match (S53: NO), in S54 the controller 51 determines whether the detection signal outputted by the cover sensor 46 changed from the second detection signal to the first detection signal. In other words, the controller 51 determines whether the cartridge 13 was replaced and the cover 22 was closed. If the controller 51 determines that the detection signal outputted by the cover sensor 46 remains the second detection signal (S54: second detection signal), the controller 51 repeats the above process from S52. Hence, the controller 51 repeats the processes in S52-S54 to determine whether a cartridge 13 was replaced until the cover 22 has been closed. Once the controller 51 determines that the detection signal outputted by the cover sensor 46 changed from the second detection signal to the first detection signal (S54: first detection signal), in S55 the controller 51 calculates the total residual quantity, cartridge residual quantity, and sub-tank residual quantity. Here, three residual quantities are those pertaining to the color of each cartridge 13 having a new serial number detected by the change in S53. More specifically, the controller 51 first reads the sub-tank residual quantity from the RAM 56. This sub-tank residual quantity is the value calculated in S18, S21 or S25 and stored in the RAM 56. Next, the controller 51 reads the initial residual quantity from the IC memory 15 on the cartridge 13 currently mounted in the mounting case 71. The controller 51 then calculates the total residual quantity by adding the sub-tank residual quantity to the initial residual quantity acquired above. As in S21 described above, the controller 51 calculates the cartridge residual quantity and the sub-tank residual quantity based on the calculated total residual quantity. The controller 51 stores this total residual quantity in the EEPROM 57 as the initial storage value. The controller 51 also stores the calculated cartridge residual quantity and the sub-tank residual quantity in the RAM 56.

In S56 the controller 51 resets the total count for color of the cartridge 13 having a new serial number detected in S53. In S57 and S58, the controller 51 sets the ink empty flag and the cartridge empty flag, respectively, to "OFF" for color of the cartridge 13 having a new serial number detected in S53. In S59 the controller 51 executes a process to restore the stored quantity of ink in the sub-tank for color of the cartridge 13 having a new serial number detected in S53. Specifically, the controller 51 opens the valve 88 that was closed in S43 of the replacement notification process described above. FIG. 4(C) shows the mounting unit 30 immediately after the old cartridge 13, which was forcibly emptied by driving the pump 87 in the process for increasing the stored quantity of ink in the sub-tank, was replaced with a new cartridge 13. FIG. 4(D) shows the mounting unit 30 after the valve 88 is opened in the process to restore the stored quantity of ink in the sub-tank. When the valve 88 is opened, ink transfers from the cartridge 13 to the sub-tank 72 via the needle 75, the pump 87, and the channel member 70 by atmospheric pressure until the level of ink stored in the cartridge 13 is approximately equal in height to the level of ink stored in the sub-tank 72.

In S60 the controller 51 sets the value for both the order flag and on-order flag to "OFF" for color of the cartridge 13 having a new serial number detected in S53, and subsequently ends the cartridge replacement process.

Effects of the First Embodiment

In the first embodiment, if ink remains in a cartridge 13 that is about to be replaced, the ink remaining in the cartridge 13 is transferred to the sub-tank 72 through the process for increasing the stored quantity of ink in the sub-tank. This process reduces the amount of ink that can be wasted when a cartridge 13 is replaced with a new cartridge 13 while the old cartridge 13 still holds ink.

When a cartridge 13 is emptied by executing the process for increasing the stored quantity of ink in the sub-tank (S43), in the embodiment a character representing the emptied cartridge 13 is displayed on the display panel 43. Accordingly, the user can be prompted to replace the cartridge 13 after the cartridge 13 has been emptied, thereby ensuring that the user replaces the cartridge at a suitable timing.

The valve 88 is opened in the process to restore the stored quantity of ink in the sub-tank (S59) after the cartridge 13 has been replaced. Accordingly, if a replacement notice is acquired after the cartridge 13 has been replaced, the maximum quantity of consumable to which the sub-tank 72 is allowed to store in the sub-tank 72 can be increased again.

First Variation of the First Embodiment

The first embodiment describes an example in which the pump 87 is used to increase the stored quantity of ink in the sub-tank 72 (the maximum quantity of consumable). The first variation of this embodiment provides an example in which the residual quantity of ink stored in the sub-tank 72 (maximum quantity of consumable) is increased by modifying the shape of the sub-tank 72. Note that all structures and processes except for the structures and processes described below are identical to the structures and processes described in the first embodiment.

The sub-tank 72 according to the first variation is provided with a lower portion 80 shown in FIGS. 8(A)-8(D), in place of the lower portion 77 described in the first embodiment. The lower portion 80 has a front part 81 constituting the front side of the lower portion 80, a rear part 82 constituting the rear of the lower portion 80, and a bellows part 83 linking the front part 81 to the rear part 82. The front part 81 is coupled to the bottom end of the upper portion 76. The front end of the bellows part 83 is coupled to the rear end of the front part 81, and the rear end of the bellows part 83 is coupled to the front end of the rear part 82. The bellows part 83 can be expanded and compressed in the front/rear directions 8. Thus, the state of the lower portion 80 can change between a compressed state shown in FIG. 8(A) in which the bellows part 83 is compressed, and an expanded state shown in FIG. 8(B) in which the bellows part 83 is expanded.

The mounting unit 30 is further provided with a sliding device 73. The sliding device 73 modifies the state of the lower portion 80 constituting the sub-tank 72 from the compressed state to the expanded state and from the expanded state to the compressed state. More specifically, the sliding device 73 is provided with a rack gear 84, a pinion gear 85, and a drive motor 86 (see FIG. 1). The rack gear 84 is fixed to the rear part 82 of the lower portion 80. The rack gear 84 has a plurality of teeth juxtaposed in the front/rear directions 8. The pinion gear 85 has a plurality of teeth that mesh with the teeth on the rack gear 84. The pinion gear 85 is rotatably supported in the housing 20, the frame described above, or the like. The drive motor 86 drives the pinion gear 85 to rotate. The drive motor 86 is connected to the controller 51 through a drive circuit (not shown). The controller 51 controls the starting and stopping of the rotation of the drive motor 86 and the direction of rotation. When rotated in one direction (hereinafter called the forward rotation), the drive motor 86 drives the pinion gear 85 to rotate in the forward direction, and the rack gear 84 meshed with the pinion gear 85 moves rearward together with the rear part 82. As a result, the bellows part 83 is extended so that the lower portion 80 of the sub-tank 72 changes from the compressed state in FIG. 8(A) to the expanded state in FIG. 8(B). When the drive motor 86 is rotated in the other direction (hereinafter called the reverse rotation), the pinion gear 85 is driven to rotate in reverse and the rack gear 84 meshed with the pinion gear 85 moves forward. As a result, the lower portion 80 of the sub-tank 72 shifts from the expanded state to the compressed state. The rear part 82 that is moved by the sliding device 73 is an example of the moving part. Note that an end of the tube 32 described above is coupled with the bottom of the front part 81 that does not move.

In S43 of the replacement notification process shown in FIG. 6(B), the controller 51 performs a process for increasing the stored quantity of ink in the sub-tank, as described in the first embodiment. However, in this variation the controller 51 changes the state of the lower portion 80 from the compressed state to the expanded state. That is, when the controller 51 determines in S42 that the cartridge residual quantity is greater than zero (S42: YES), the controller 51 drives the drive motor 86 in the forward rotation for a prescribed time. This prescribed time is a sufficient amount of time for moving the lower portion 80 from the compressed state to the expanded state, for example, and is pre-stored in the EEPROM 57 of the memory 53. When the lower portion 80 of the sub-tank 72 is expanded, ink stored in the cartridge 13 (see FIG. 8(A)) is transferred into the sub-tank 72 by atmospheric pressure, thereby emptying the cartridge 13 (see FIG. 8(B)). Hence, by driving the drive motor 86 in the forward rotation, the controller 51 can forcibly empty the cartridge 13 as in the first embodiment.

In this variation, changing the state of the sub-tank 72 from a compressed state to an expanded state in order to transfer ink from the cartridge 13 to the sub-tank 72 is an example of expanding a maximum quantity of consumable.

Figure 6:
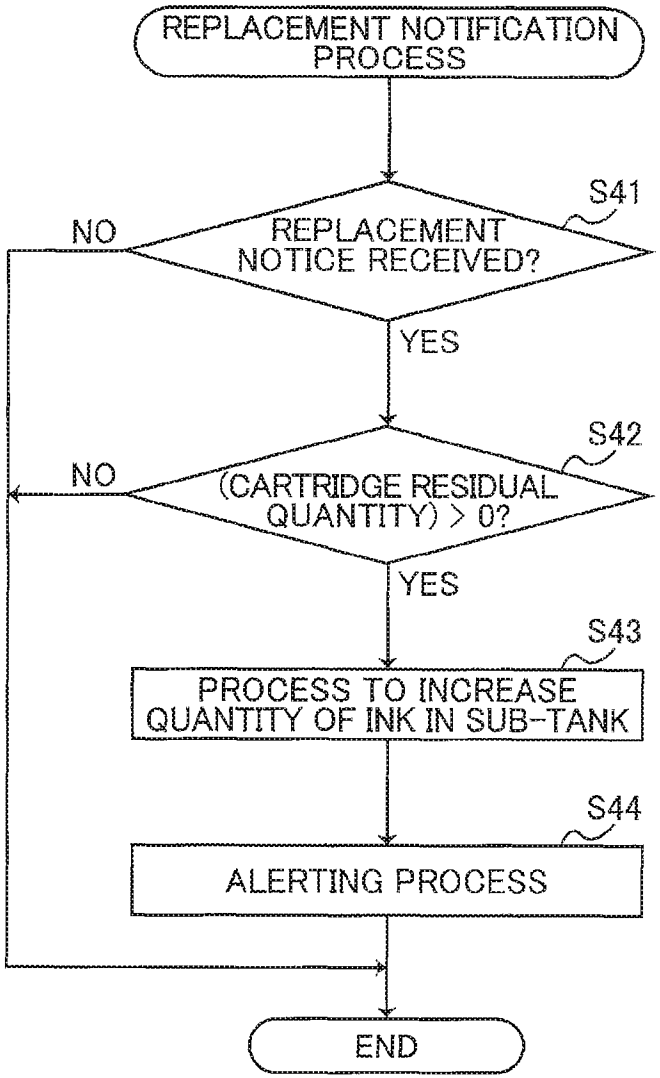
FIG. 6(A) is a flowchart illustrating steps in a transmission process executed by the controller of the printer according to the first embodiment.
FIG. 6(B) is a flowchart illustrating steps in a replacement notification process executed by the controller according to the first embodiment.
FIG. 6(C) is a flowchart illustrating steps in a cartridge replacement process executed by the controller of the printer according to the first embodiment.
Figure 6:
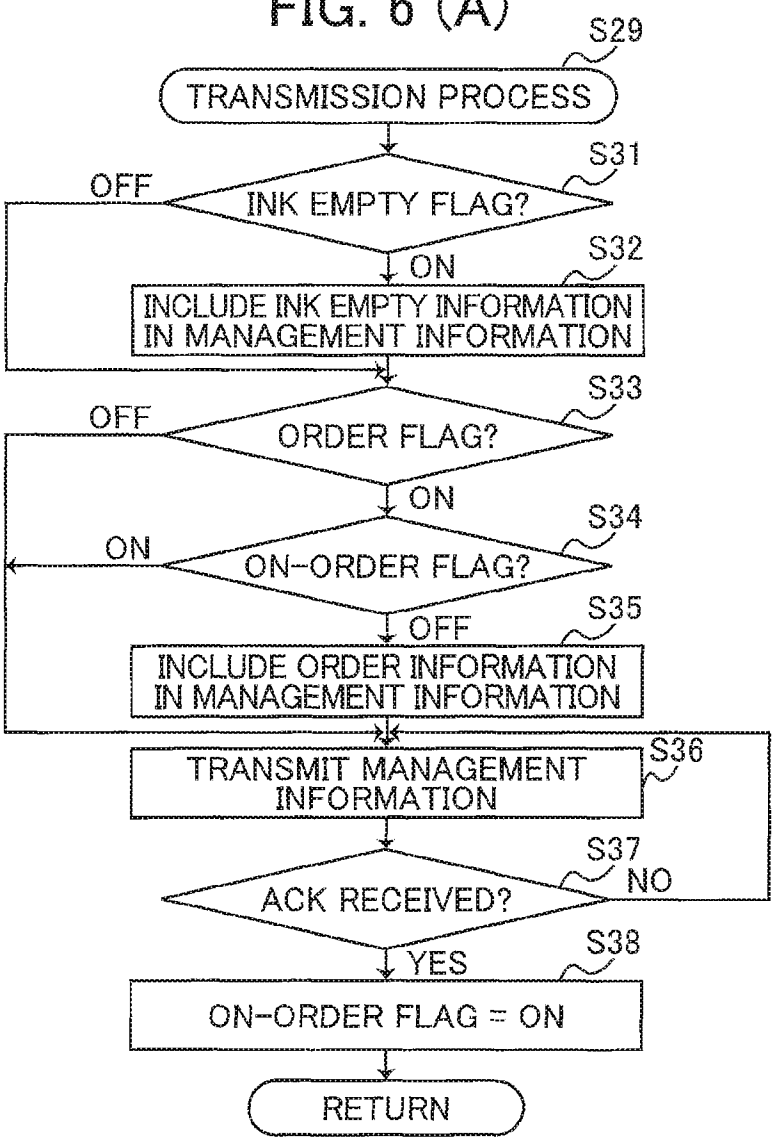
Figure 6:
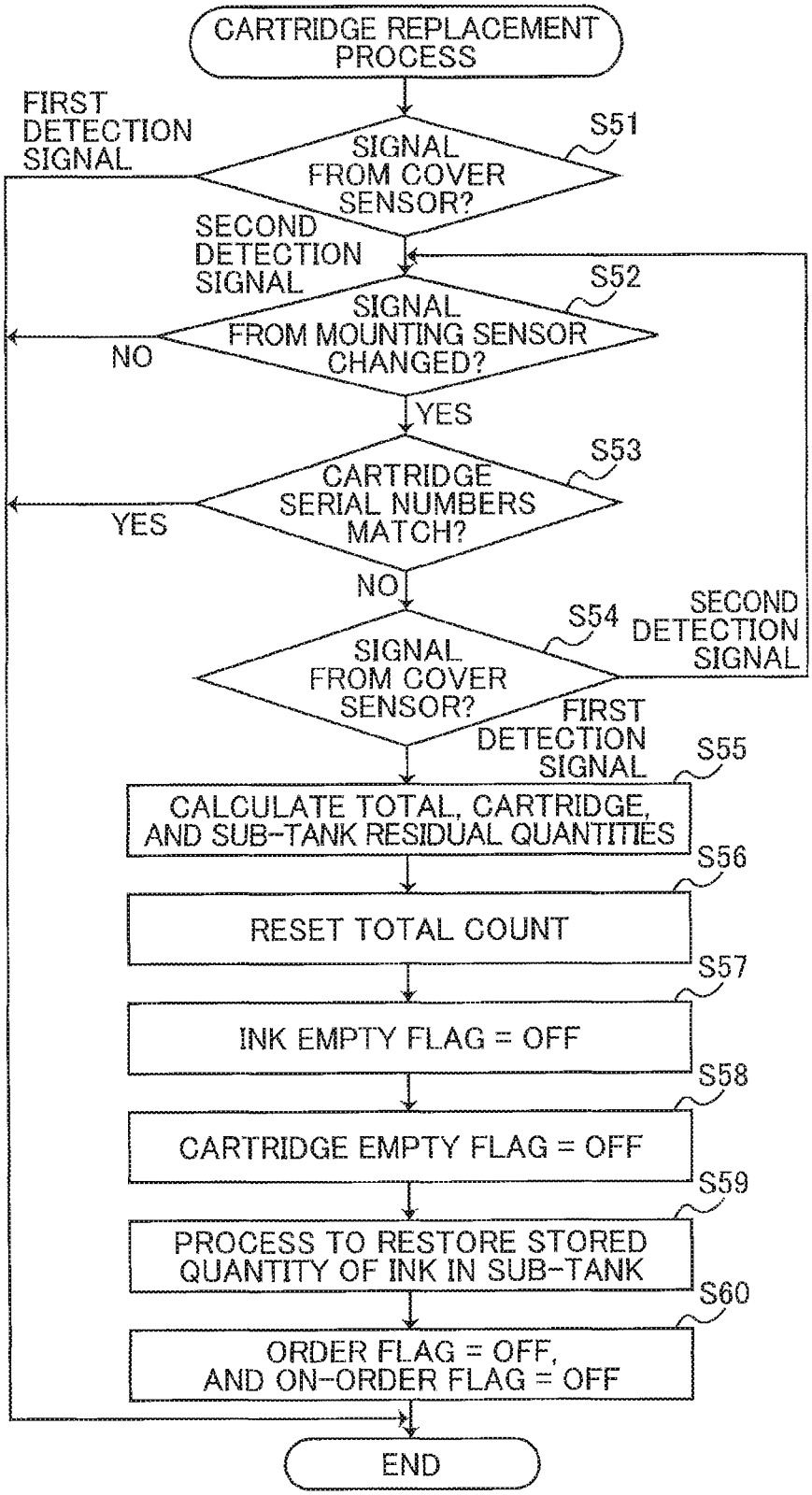

For the process to restore the stored quantity of ink in the sub-tank described in S59 of the cartridge replacement process shown in FIG. 6 (C), the controller 51 executes a compression process by driving the drive motor 86 in the reverse rotation for a prescribed time. By executing this compression process, a portion of the ink stored in the sub-tank 72 (see FIG. 8(C)) is transferred into the cartridge 13 by atmospheric pressure (see FIG. 8(D)). Here, the volume of the interior space in the upper portion 76 of the sub-tank 72 is sufficiently large to prevent ink from spilling out of the liquid chamber 79 through the air communication port 78 of the sub-tank 72 during the compression process. Further, the mounted height of the cartridge 13 is sufficiently higher than the sub-tank 72 to prevent ink from spilling out of the cartridge 13 through the air communication port 17 during the compression process.

Effects of the First Variation of the First Embodiment

In this variation, ink remaining in the cartridge 13 is transferred into the sub-tank 72 by expanding the sub-tank 72 when a cartridge 13 about to be replaced still holds residual ink. Therefore, the variation reduces ink wastage that occurs when a cartridge 13 with residual ink is replaced by a new cartridge 13.

This variation describes an example in which the state of the sub-tank 72 is changed from a compressed state to an expanded state by the sliding device 73. However, the state of the sub-tank 72 may be changed between the compressed state and the expanded state either manually or through a sliding device of another construction. Further, the state of the sub-tank 72 is changed by means of the bellows part 83 in this variation. However, the sub-tank 72 may be provided with a film or other flexible member in place of the bellows part 83.

Second Variation of the First Embodiment

The second variation describes an example in which the printer 10 is provided with a mounting unit 100 shown in FIGS. 9(A)-9(D) in place of the mounting unit 30. All structures other than the mounting unit 100 are identical to the structures described in the first embodiment. Further, structures and processes not described below are identical to the structures and processes described in the first embodiment.

The mounting unit 100 is provided with a mounting case 101 that is retained in the housing 20. The mounting case 101 has a box shape with an opening on the top. Cartridges 110 are inserted into and removed from the mounting case 101 through this opening. The mounting case 101 detachably retains four cartridges 110. One set of components is provided for each cartridge 110. The components constituting this one set includes a sub-tank 102, a liquid level sensor 33, a cartridge interface 74, a drive motor 107, and two needles 103 and 104. In other words, four of the above sets are provided in the mounting unit 100. The sub-tank 102 is provided below the mounting case 101. Since each of the sets has the same structure, only one set will be described below.

The cartridge 110 is box-shaped and has an interior space for storing ink. The interior space of the cartridge 110 is the liquid chamber 18. The cartridge 110 has an outlet 112 in which the needles 103 and 104 are inserted. The liquid level sensor 33 is disposed at a position slightly higher than the inner bottom surface of the cartridge 110 mounted in the mounting case 101.

The needles 103 and 104 are retained in the mounting case 101. The top ends of the needles 103 and 104 protrude to a position above the inner bottom surface of the mounting case 101. When the cartridge 110 is mounted in the mounting case 101, the top ends of the needles 103 and 104 are inserted through the outlet 112 of the cartridge 110 and become positioned in the interior space of the cartridge 110. The bottom ends of the needles 103 and 104 protrude below the bottom of the mounting case 101 and are positioned in the interior space of the sub-tank 102 described later. Thus, the interior space of the sub-tank 102 and the interior space of the cartridge 110 mounted in the mounting case 101 are in communication through the needles 103 and 104. The needle 104 is an example of the second cylindrical body. The interior space of the needle 104 is an example of the second channel.

The needle 103 has an outer cylinder 105, and an inner cylinder 106 disposed inside the outer cylinder 105. The inner cylinder 106 is retained in the outer cylinder 105 so as to be capable of sliding along the center axis of the outer cylinder 105. The inner cylinder 106 can slide between a housed position in which the inner cylinder 106 is fully accommodated in the outer cylinder 105 (see FIG. 9(B)) and a protruded position in which the bottom end of the inner cylinder 106 protrudes downward from the bottom end of the outer cylinder 105 (see FIG. 9(A)). The drive motor 107 drives the inner cylinder 106 to slide between the housed position and the protruded position. The needle 103 is an example of the first cylindrical body. The interior space of the needle 103 is an example of the first channel. The opening formed in the bottom end of the needle 103 is an example of the through-hole.

The sub-tank 102 has a box shape. The sub-tank 102 has an interior space called the liquid chamber 79 that can store ink. One end of the tube 32 described above is coupled with the bottom of the sub-tank 102. The liquid chamber 79 of the sub-tank 102 is in communication with a channel in the head 31 through the tube 32. An air communication port 108 is formed in the top wall constituting the sub-tank 102. Hence, the interior space of the sub-tank 102 is open to the atmosphere. Note that the interior space of the cartridge 110 is not open to the atmosphere.

Here, the phenomenon by which ink stored in the cartridge 110 moves into the sub-tank 102 through the needle 104 will be described. When a cartridge 110 storing ink is mounted in the mounting case 101 while the sub-tank 102 is in an empty state, ink stored in the cartridge 110 flows into the sub-tank 102 through the needle 104. At this time, air in the sub-tank 102 flows into the cartridge 110 through the needle 103. Hence, ink and air are exchanged between the cartridge 110 and the tank 102. Note that the needle 103 is configured with an inner diameter of a size through which air can pass but ink is difficult to pass.

Ink that flows into the sub-tank 102 from the cartridge 110 accumulates in the liquid chamber 79 of the sub-tank 102. When the level of ink accumulating in the sub-tank 102 reaches the bottom end of the needle 103, air can no longer pass through the needle 103 into the interior space of the cartridge 110. Consequently, the flow of ink from the cartridge 110 to the sub-tank 102 through the needle 104 is halted. That is, ink flows from the cartridge 110 into the sub-tank 102 until the level of ink stored in the sub-tank 102 reaches a height equivalent to the bottom end of the needle 103. As ink stored in the sub-tank 102 is subsequently expended during printing, the level of ink stored in the sub-tank 102 drops below the bottom end of the needle 103. At this time, air is again transferred from the sub-tank 102 into the cartridge 110 through the needle 103. As air passes into the cartridge 110, ink flows from the cartridge 110 into the sub-tank 102 through the needle 104. Once the level of ink stored in the sub-tank 102 again reaches the bottom end of the needle 103, the flow of ink from the cartridge 110 into the sub-tank 102 stops, as described above.

If the controller 51 determines in the replacement notification process of FIG. 6(B) that the cartridge residual quantity is greater than zero (S42: YES), the controller 51 drives the drive motor 107 in the process of S43 for increasing the stored quantity of ink in the sub-tank. When the controller 51 drives the drive motor 107, the inner cylinder 106 of the needle 103 slides from the protruded position toward the housed position. In other words, the bottom end of the needle 103 moves upward. At this time, air in the sub-tank 102 flows through the needle 103 into the cartridge 110, and ink in the cartridge 110 flows through the needle 104 into the sub-tank 102. When the level of ink stored in the sub-tank 102 reaches the bottom end of the needle 103, ink stops flowing from the cartridge 110 into the sub-tank 102. Thus, the quantity of ink stored in the sub-tank 102 is increased by moving the bottom end of the needle 103 upward. The action of moving the bottom end of the needle 103 upward to allow ink to flow from the cartridge 110 into the sub-tank 72 is one example for expanding a maximum quantity of consumable.

In the process of S59 in FIG. 6(C) for restoring the stored quantity of ink in the sub-tank, the controller 51 drives the drive motor 107 to slide the inner cylinder 106 of the needle 103 from the housed position toward the protruded position.

Figure 9:
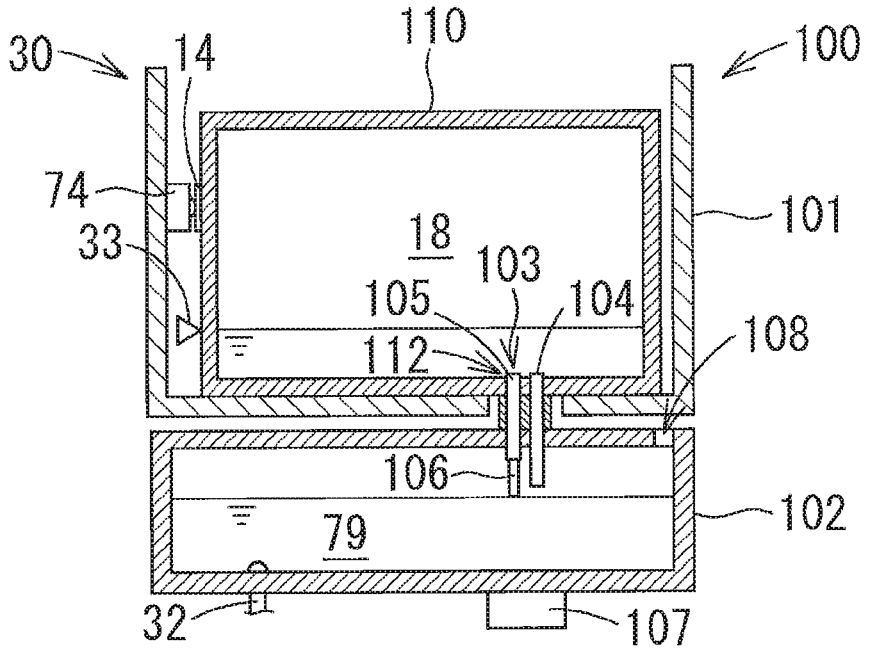
FIGS. 9(A)-9(D) are explanatory diagrams illustrating operations of an inner cylinder in a printer according to a second variation of the first embodiment.
Figure 9:
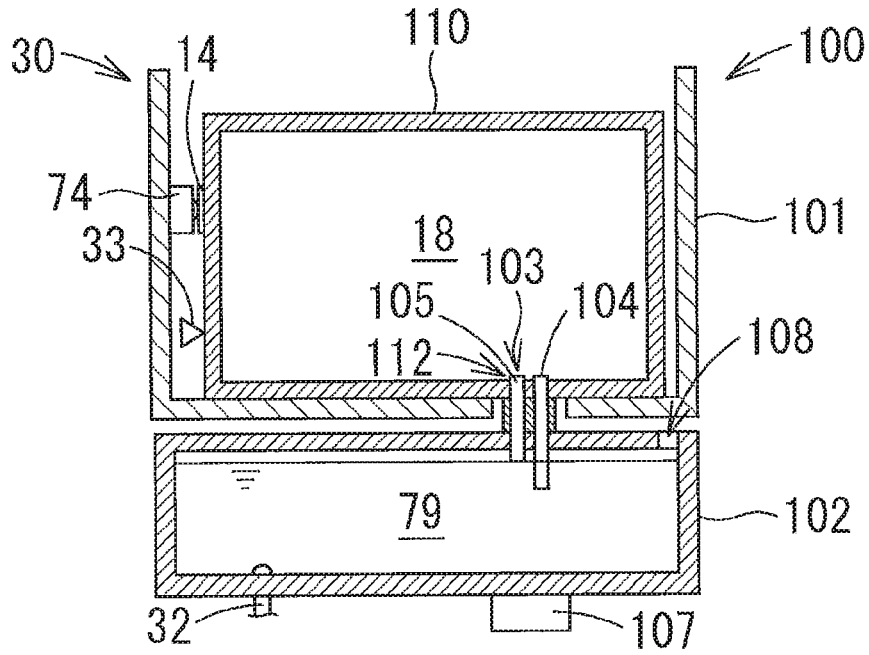
Figure 9:
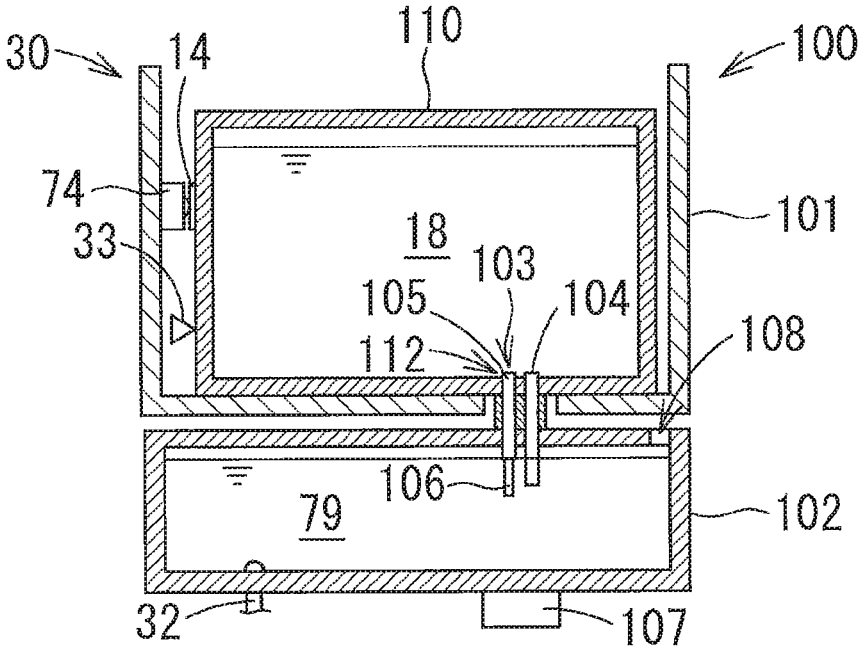
Figure 9:
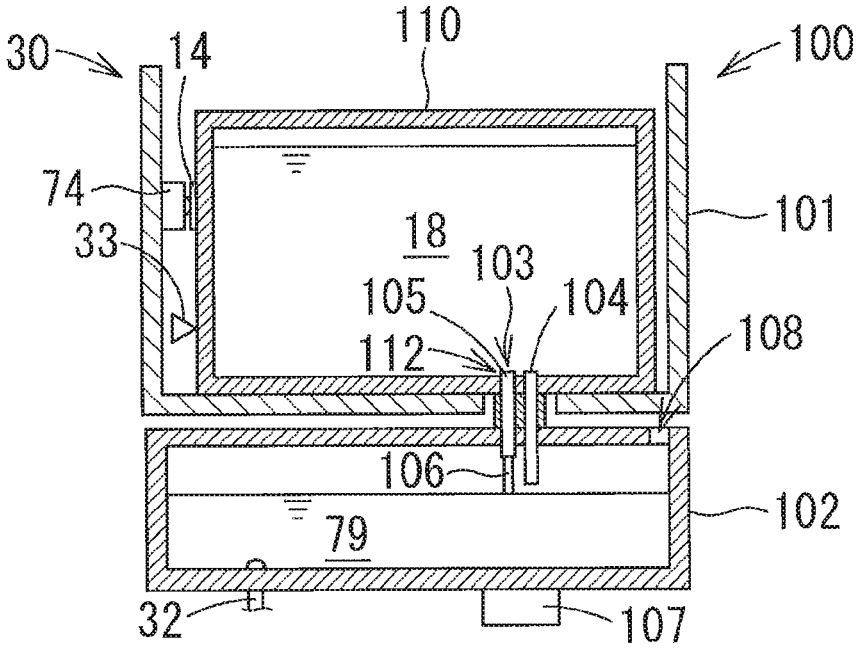

FIG. 9(C) shows the state of the mounting unit 100 after the empty cartridge 110 has been replaced with a new cartridge 110 and the process in S59 to restore the stored quantity of ink in the sub-tank has been performed. In this state, ink does not flow from the cartridge 110 into the sub-tank 102, even if a new cartridge 110 storing ink were mounted in the mounting case 101. Hence, ink will not spill out of the liquid chamber 79 through the air communication port 108 formed in the sub-tank 102. The level of ink stored in the sub-tank 102 drops as ink is expended through printing. When the level of ink drops lower than the bottom end of the needle 103, ink once again flows through the needle 104 from the cartridge 110 to the sub-tank 102 (see FIG. 9(D)).

Effects of the Second Variation of the First Embodiment

When a cartridge 13 about to be replaced still holds residual ink, in the second variation the ink remaining in the cartridge 13 is transferred to the sub-tank 72 by sliding the inner cylinder 106 of the needle 103 from the protruded position toward the housed position. This variation thereby reduces the likelihood of ink being wasted due to a cartridge 13 being replaced with a new cartridge 13 while the old cartridge 13 still holds ink. Note that an electromagnet or the like may be used in place of the drive motor 107.

Other Variations of the First Embodiment

The first embodiment describes an example in which the controller 51 executes the process to restore the stored quantity of ink in the sub-tank (S59) when a cartridge 13 has been replaced (S52: YES). However, the controller 51 may instead execute the process to restore the stored quantity of ink in the sub-tank (S59) after receiving input through the touch-sensor film 44 or the switches 45 indicating that a cartridge 13 was replaced.

The first embodiment describes an example in which the alert message 93 and the "!" object 94 are displayed on the display panel 43 (see FIG. 7(B)) when a cartridge 13 mounted in the mounting case 71 becomes empty. However, the alert message 93 and "!" object 94 may be displayed on the display panel 43 when the cartridge residual quantity drops below a prescribed threshold.

The first embodiment describes an example in which ink is transferred from the cartridge 13 into the sub-tank 72 by gravity and atmospheric pressure when ink is consumed during printing. However, ink may be transferred from the cartridge 13 to the sub-tank 72 by a pump 87 as ink is consumed in printing. To give an example of this process, the level of ink drops as printing is executed until eventually the detection signal outputted by the liquid level sensor 33 changes from the first detection signal to the second detection signal. At this time, the controller 51 supplies ink from the cartridge 13 into the sub-tank 72 by driving the pump 87 until the detection signal outputted by the liquid level sensor 33 changes back from the second detection signal to the first detection signal. In the process for increasing the stored quantity of ink in the sub-tank, the controller 51 continuously drives the pump 87 for a prescribed time, even after the detection signal outputted from the liquid level sensor 33 changes from the second detection signal to the first detection signal, thereby supplying a greater amount of ink from the cartridge 13 to the sub-tank 72. This process is also an example for expanding a maximum quantity of consumable.

The first embodiment also describes an example in which the controller 51 performs the process for increasing the stored quantity of ink in the sub-tank when the cartridge residual quantity is greater than zero in the replacement notification process (S42: YES). However, the controller 51 may instead perform the process for increasing the stored quantity of ink in the sub-tank when the cartridge residual quantity is greater than or equal to a prescribed non-zero threshold (an example of the prescribed threshold). This prescribed threshold is preferably a small value since the objective is to reduce the amount of residual ink in the cartridge from what would remain if the process for increasing the stored quantity of ink in the sub-tank were not performed.

The first embodiment describes an example in which the liquid level sensor 33 is arranged at the same height as the vertical position of the needle 75. In other words, the first embodiment describes an example in which the detection signal outputted by the liquid level sensor 33 changes when the cartridge 13 becomes empty. However, the liquid level sensor 33 may be arranged at a position higher than the needle 75 instead.

In the first embodiment, the controller 51 determines whether or not to execute the process for increasing the stored quantity of ink in the sub-tank for each color (S41, S42) and only executes the process of S43 to increase the stored quantity of ink on sub-tanks 72 of colors for which a positive determination was made. However, the controller 51 may increase the stored quantity of ink in the sub-tanks 72 of all colors when determining that the stored quantity of ink in one sub-tank 72 should be increased.

Second Embodiment

Next, a printer 10 according to a second embodiment will be described.

The printer 10 according to the second embodiment has configurations of a sub-tank, a mounting unit, and cartridges different from those of the first embodiment. In the following description, like parts and components to those in the first embodiment are designated with the same reference numerals.

Figure 10:
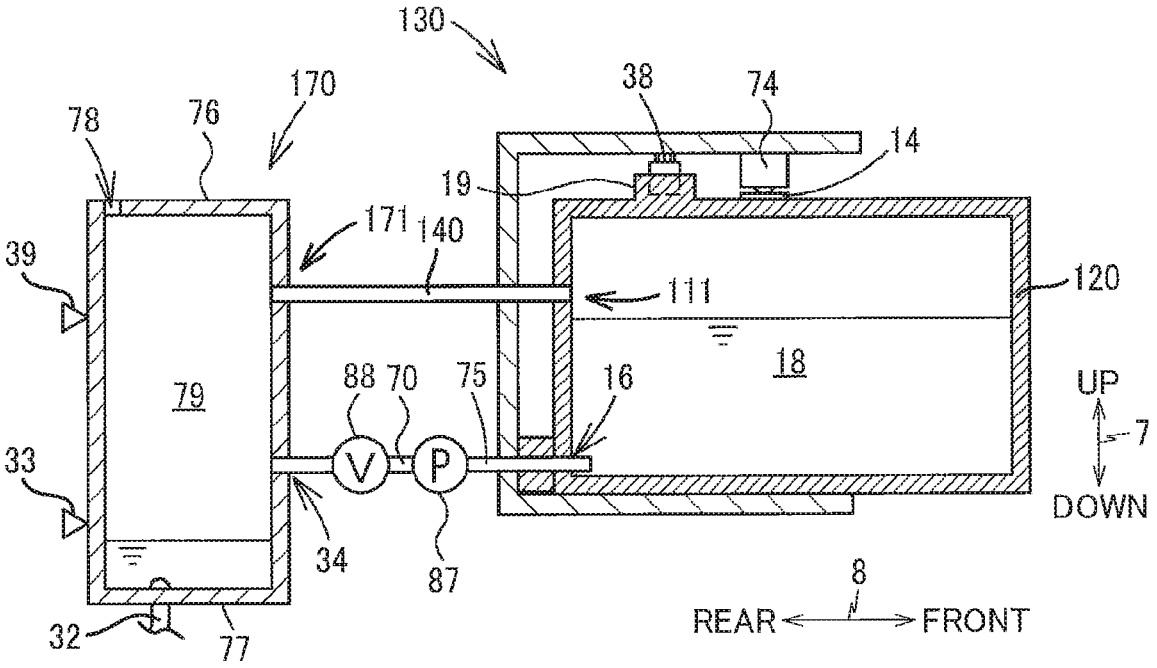
FIG. 10 is a vertical cross-sectional view schematically illustrating a configuration of a printer according to a second embodiment.

As shown in FIG. 10, the printer 10 according to the second embodiment is provided with four sub-tanks 170, a mounting unit 130, and four cartridges 120. The mounting unit 130 detachably retains the cartridges 120.

The sub-tank 170 has an upper portion 76. An outlet 171 is formed in the front wall of the upper portion 76. A channel member 140 is inserted into the outlet 171.

The printer 10 also has four liquid level sensors 39 corresponding to the four sub-tanks 170. Each liquid level sensor 39 is disposed at a position whose height corresponds to the upper limit of ink that the sub-tank 170 can store. The liquid level sensor 39 detects whether the ink stored in the sub-tank 170 reaches this height. Specifically, the liquid level sensor 39 is disposed in the sub-tank 170 at a position higher than the liquid level sensor 33 and slightly lower than the outlet 171. The liquid level sensor 39 has an identical structure to the liquid level sensor 33. In other words, the liquid level sensor 39 is a photo interrupter having a light-emitting diode and a photodiode. The light-emitting diode and the photodiode are arranged so as to confront the sub-tank 170 from respective left and right sides. Hence, the sub-tank 170 is positioned in the path of light emitted from the light-emitting diode of the liquid level sensor 39. The liquid level sensor 39 outputs signals having different voltage values depending on whether ink is present or not present in the path of light. Specifically, the liquid level sensor 39 outputs a first detection signal when ink is present in the path of light, and outputs a second detection signal when ink is not present in the path of light. Hence, the liquid level sensor 39 outputs different detection signals depending on whether ink in the corresponding sub-tank 170 is present at the height of the liquid level sensor 39. As shown in FIG. 1, the liquid level sensor 39 is connected to the controller 51. Therefore, the controller 51 can receive detection signals from the liquid level sensors 39.

An inlet 111 is formed in a side wall of the cartridge 120. The channel member 140 is inserted into the inlet 111. The interior space of the sub-tank 170 is in communication with the interior space of the cartridge 120 through the inlet 111, the outlet 171 formed in the sub-tank 170, and the channel member 140. An air communication port is not formed in the cartridge 120. Since the air communication port 78 is formed in the sub-tank 170, the cartridge 120 is open to the atmosphere via the channel member 140 and the sub-tank 170. It would also be possible to configure the inlet 111 in the cartridge 120 to be open to the atmosphere. In this case, the outlet 171 need not be formed in the sub-tank 170, and the sub-tank 170 and the cartridge 120 need not be in communication via the channel member 140.

In the first embodiment, the valve 88 is opened when a new cartridge 13 is mounted in the mounting case 71 and the process to restore the stored quantity of ink in the sub-tank (S59) is executed, and is kept open until the process for increasing the stored quantity of ink in the sub-tank (S43) is executed because the first embodiment uses atmospheric pressure on ink in the cartridge 13 and ink in the sub-tank 72 (hydraulic head differential) to supply ink from the cartridge 13 to the sub-tank 72. However, the second embodiment uses the pump 87 rather than atmospheric pressure (hydraulic head differential) to supply ink from the cartridge 120 to the sub-tank 170. Here, the valve 88 works in conjunction with the pump 87 so that the valve 88 is open when the pump 87 is driving and is closed at all other times.

Figure 11:
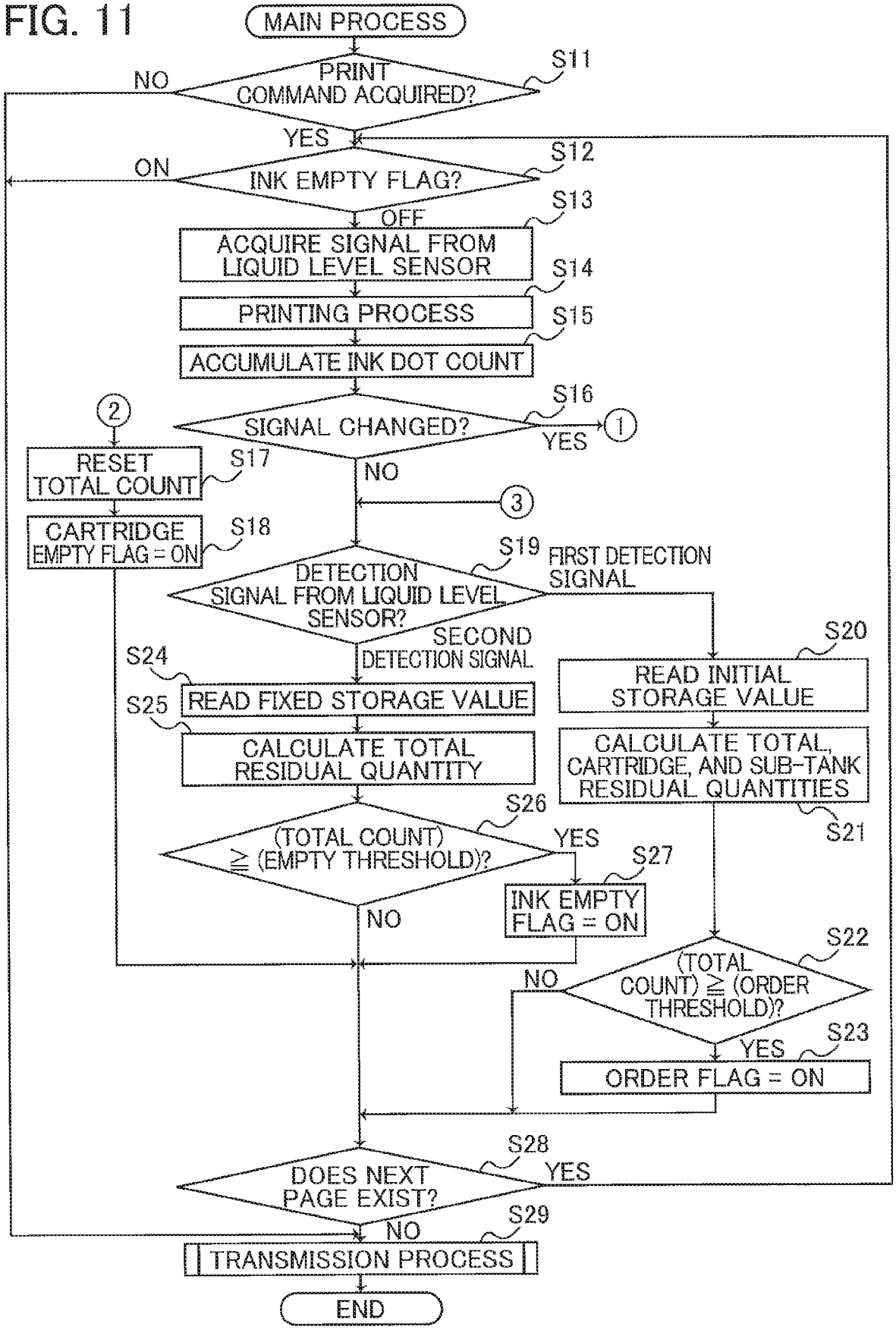
FIG. 11 is a flowchart illustrating a part of steps in a main process executed by a controller of the printer according to the second embodiment.

Next, the main process according to the second embodiment will be described with reference to FIGS. 11 and 12. The main process according to the second embodiment differs from the main process according to the first embodiment in how the controller 51 branches in S16 and proceeds to either S17 or S19. As in the first embodiment, the controller 51 determines in S16 of the second embodiment whether the value outputted from the liquid level sensor 33 has changed. If the controller 51 determines that the detection signal outputted by the liquid level sensor 33 has not changed (S16: NO), the controller 51 advances to S19.

However, when the controller 51 determines in S16 that the detection signal outputted by the liquid level sensor 33 has changed (S16: YES), the controller 51 advances to S111 in FIG. 12. Thus, the controller 51 reaches a YES determination in S16 when ink is consumed to the point that the detection signal of the liquid level sensor 33 changes from the first detection signal to the second detection signal. In other words, the controller 51 reaches a YES determination in S16 when the quantity of ink in the sub-tank 170 prior to the printing process in S14 is greater than a prescribed quantity and when the quantity of ink in the sub-tank 170 after the printing process in S14 has dropped below the prescribed quantity. In S111 the controller 51 begins driving the pump 87 and in S112 waits while a prescribed time t1 has not elapsed (S112: NO). When the controller 51 determines that the prescribed time t1 has elapsed (S112: YES), in S113 the controller 51 halts the pump 87. Thus, if any ink remains in the cartridge 120, this ink is supplied from the cartridge 120 into the sub-tank 170 through the process in S111-S113, and the liquid level sensor 33 will begin to output the first detection signal. In S114 the controller 51 determines whether the detection signal outputted by the liquid level sensor 33 has returned from the second detection signal to the first detection signal. When the detection signal from the liquid level sensor 33 has returned to the first detection signal (S114: YES), the controller 51 advances to S19 in FIG. 11. However, if the detection signal outputted by the liquid level sensor 33 remains at the second detection signal (S114: NO), the controller 51 advances to S17 in FIG. 11.

According to the main process described above, ink is not supplied from the cartridge 120 to the sub-tank 170 while the value outputted from the liquid level sensor 33 has not changed (S16: NO), even after executing the printing process. If the detection signal from the liquid level sensor 33 changes from the first detection signal to the second detection signal, the controller 51 drives the pump 87 so that ink is supplied from the cartridge 120 to the sub-tank 170.

Next, the process for increasing the stored quantity of ink in the sub-tank (S43 of FIG. 6(B)) according to the second embodiment will be described. In this process, the controller 51 drives the pump 87. The length of time that the controller 51 drives the pump 87 is at most a prescribed time t2. The prescribed time t2 is longer in duration than the prescribed time t1.

The prescribed time t2 is set to a length of time for transferring ink remaining in the cartridge 120 to the sub-tank 170 when performing the process for increasing the stored quantity of ink in the sub-tank immediately after the order flag was set to "ON" in S23. The liquid level sensor 39 is located at an upper limit position where problem will appear if the level of ink stored in the sub-tank 170 is above this upper limit. Ink is transferred from the cartridge 120 to the sub-tank 170 using the maximum supply capacity of the pump 87 for the prescribed time t2 immediately after the order flag was set to "ON" in S23.

After starting the pump 87, the controller 51 stops the pump 87 if the detection signal outputted from the liquid level sensor 39 changes from the second detection signal to the first detection signal before the prescribed time t2 has elapsed. At this time, ink has been supplied into the sub-tank 170 up to the height of the liquid level sensor 39. In this case, the ink may remain in the cartridge 120. However, the process in this embodiment can reduce wastage of ink compared to a case where the process for increasing the stored quantity of ink in the sub-tank is not executed. Alternatively, printer may be configured so that the level of ink in the sub-tank 170 cannot reach a height corresponding to the upper limit even if all the ink remained in the cartridge 120 moves to the sub-tank 170 in the process for increasing the stored quantity of ink in the sub-tank, and the liquid level sensor 39 may be eliminated. However, including the liquid level sensor 39 can prevent an unexpected amount of ink from being supplied into the sub-tank 170, thereby preventing the level of ink from surpassing the height corresponding to the upper limit of ink that can be stored in the sub-tank 170.

The cartridge replacement process according to the second embodiment is identical to that in the first embodiment (see FIG. 6(C)), except for the following points. First, the controller 51 does not perform the process in S59 to restore the stored quantity of ink in the sub-tank. Further, the process in S55 is performed as follows. When the liquid level sensor 33 is outputting the second detection signal (i.e., when the level of ink is below the liquid level sensor 33), the controller 51 drives the pump 87 for a prescribed time t3 in order to supply ink from the cartridge 120 into the sub-tank 170. The prescribed time t3 is set to a length of time that is greater than or equal to the prescribed time t1 and less than the prescribed time t2. If the detection signal outputted by the liquid level sensor 33 has changed to the first detection signal after the pump 87 was driven for the prescribed time t3, then it can be determined that a new cartridge 120 was mounted in the mounting unit 130 and ink from the new cartridge was supplied into the sub-tank 170. In this case, as in the first embodiment, the controller 51 calculates the total residual quantity, the cartridge residual quantity, and the sub-tank residual quantity and advances to S56.

However, if the detection signal outputted by the liquid level sensor 33 remains at the second detection signal after the pump 87 was driven for the prescribed time t3, then a used cartridge 120 was likely mounted in the mounting unit 130. In this case, the controller 51 executes an error process, for example, and does not continue the process from S56. In the error process, the controller 51 may display an error message on the display panel 43 indicating that a used cartridge has been mounted, for example. Alternatively, the controller 51 may display a message prompting the user to mount a new cartridge.

If the liquid level sensor 33 is outputting the first detection signal when the controller 51 advances from S54 to S55, ink has already been supplied into the sub-tank 170 to a position higher than the liquid level sensor 33. Accordingly, in S55 the controller 51 calculates the total residual quantity, the cartridge residual quantity, and the sub-tank residual quantity without starting the corresponding pump 87, and subsequently advances to S56.

Effects of the Second Embodiment

Figure 12:
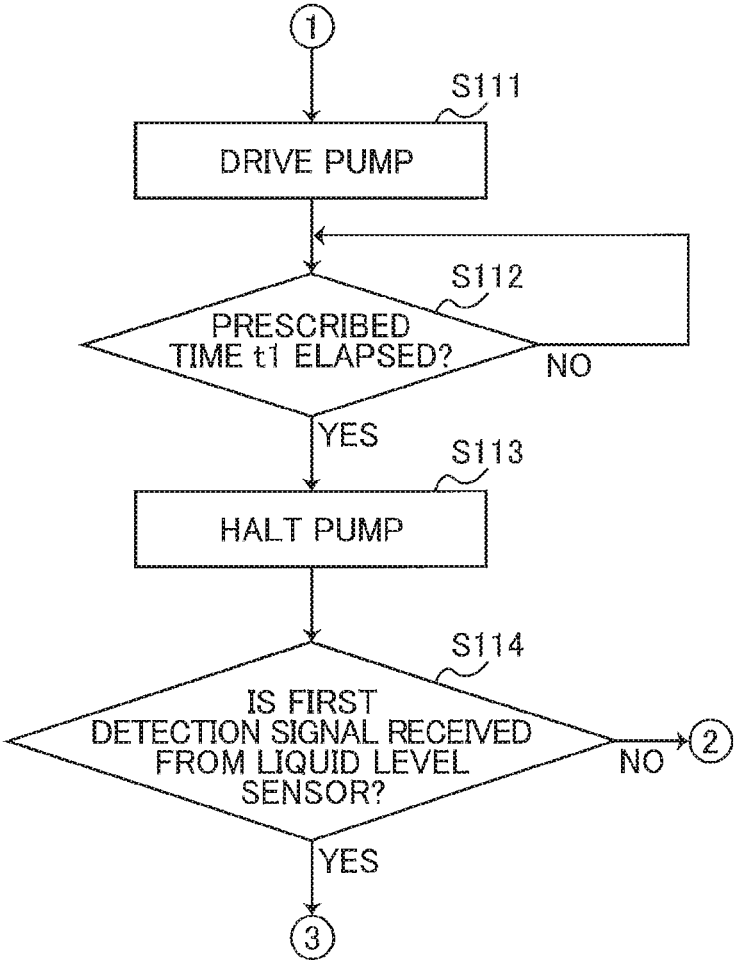
FIG. 12 is a flowchart illustrating a remaining part of steps in the main process shown in FIG. 11.

With the printer 10 according to the second embodiment, the pump 87 is driven to supply ink from the cartridge 120 to the sub-tank 170 through the process in steps S111-S113 of FIG. 12. Accordingly, ink can be suitably supplied from the cartridge 120 to the sub-tank 170. In the replacement notification process of FIG. 6(B), the controller 51 executes the process in S43 for increasing the stored quantity of ink in the sub-tank. In this process, the controller 51 drives the pump 87 to supply remaining ink in the cartridge 120 into the sub-tank 170, thereby reducing ink wastage caused by replacing a cartridge 120 that still holds some ink with a new cartridge 120.

First Variation of the Second Embodiment

In the second embodiment, the pump 87 is configured to supply ink directly from the cartridge 120 to the sub-tank 170, but an air pump may be provided in the mounting case 71 instead of the pump 87, and the air pump is configured to supply the cartridge 120 with compressed air from atmosphere. In this case, ink is transferred from the cartridge 120 to the sub-tank 170 by the compressed air supplied into the cartridge 120, and internal pressure in the cartridge 120 is increased. In this variation, the structure shown in FIG. 10 is modified as follows. The valve 88 is directly connected to the needle 75 without the pump 87 interposed therebetween. Further, the outlet 171 is not formed in the sub-tank 170 and, hence, an end of the channel member 140 is not connected to the outlet 171. Instead, the end of the channel member 140 is opened to the atmosphere, while the other end is connected to the inlet 111. An air pump is connected between the two ends of the channel member 140. When driven, the air pump draws in air to generate compressed air and supplies this compressed air into the cartridge 120. At this time the valve 88 is opened and the compressed air supplied to the cartridge 120 pushes ink out of the cartridge 120 toward the sub-tank 170.

Second Variation of the Second Embodiment

In the second variation, the structure shown in FIG. 10 is modified as follows to achieve a structure using compressed air. As in the second variation of the second embodiment, the valve 88 is directly connected to the needle 75 without the pump 87 interposed therebetween. Further, an air pump is connected between the two ends of the channel member 140. However, the end of the channel member 140 that is open to the atmosphere in the first variation is connected to the outlet 171 in the second variation, while the other end of the channel member 140 is connected to the inlet 111. With this configuration, the air pump can still generate compressed air by drawing in air through the air communication port 78.

Third Variation of the Second Embodiment

While the liquid level sensor 39 is disposed at an upper limit position in the sub-tank 170 in the second embodiment described above, the liquid level sensor 39 may be disposed at a lower position, provided that the liquid level sensor 39 is above the liquid level sensor 33. For example, the liquid level sensor 39 may be positioned at a height that the level of ink in the sub-tank 170 will reach if ink is transferred from the cartridge 120 to the sub-tank 170 by the maximum supplying capacity of the pump 87 for the prescribed time t1 beginning from the time that the level of ink in the sub-tank 170 is at the height of the liquid level sensor 33. With this configuration, the controller 51 waits in S112 of FIG. 12 while the first detection signal is not outputted from the liquid level sensor 39 (S112: NO). When the first detection signal is acquired from the liquid level sensor 39 (S112: YES), the controller 51 halts the pump 87 in S113. Also with this configuration, the controller 51 may drive the pump 87 for the prescribed time t2 in the process for increasing the stored quantity of ink in the sub-tank (S43) without referencing the signals outputted from the liquid level sensor 39.

What is claimed is:

1. An image-recording device comprising:

a mount body configured to detachably hold a cartridge, the cartridge having a first chamber configured to store consumable therein and an outlet;

a tank configured to be in communication with the cartridge when the cartridge is held by the mount body, the tank having a second chamber configured to store consumable and an inlet, and consumable in the first chamber being capable of moving into the second chamber via the outlet of the cartridge and the inlet of the tank;

a recording device configured to record an image using consumable outputted from the second chamber;

a communication interface; and a controller configured to perform:

determining whether a residual quantity of consumable stored in the first chamber of the cartridge held by the mount body is lower than or equal to a prescribed threshold, the prescribed threshold being no less than zero; and expanding, when a specific condition is satisfied, a maximum quantity of consumable up to which consumable is capable of being stored in the second chamber, the specific condition including a first condition that the residual quantity of consumable stored in the first chamber is higher than the prescribed threshold, and a second condition that information notifying that the cartridge is to be replaced is received at the communication interface.

2. The image-recording device according to claim 1, wherein the controller is configured to further perform notifying, in a case where it is determined that the residual quantity of consumable stored in the first chamber is lower than or equal to the prescribed threshold, that the residual quantity of consumable stored in the first chamber becomes low.

3. The image-recording device according to claim 1, further comprising a pump configured to transfer consumable in the first chamber to the second chamber of the cartridge held by the mount body, wherein in the expanding, the pump is used to expand the maximum quantity of consumable.

4. The image-recording device according to claim 1, wherein the tank further comprises a movable part which defines at least part of the second chamber and is configured to move for changing a volume of the second chamber, and wherein in the expanding, the controller is configured to expand the maximum quantity of consumable by moving the movable part.

5. The image-recording device according to claim 4, wherein both the first chamber of the cartridge held by the mount body and the second chamber are open to atmosphere, and wherein the expanding increases a volume of a specific portion of the second chamber, the specific portion being below the inlet of the second chamber.

6. The image-recording device according to claim 1, wherein the mount body includes a mounting sensor configured to output different signals depending on whether the cartridge is mounted to the mount body or detached from the mount body, wherein the expanding increases the maximum quantity of consumable from an initial maximum quantity to an expanded maximum quantity larger than the initial maximum quantity, and wherein the controller is configured to further perform restoring the maximum quantity of consumable from the expanded maximum quantity to the initial maximum quantity when determining that the cartridge is mounted on the mount body based on a signal outputted from the mounting sensor.

7. The image-recording device according to claim 1, further comprising an input interface configured to receive a user input, wherein the expanding increases the maximum quantity of consumable from an initial maximum quantity to an expanded maximum quantity larger than the initial maximum quantity, and wherein the controller is configured to further perform restoring the maximum quantity of consumable from the expanded maximum quantity to the initial maximum quantity when a user input indicating that the cartridge is replaced is received at the input interface.

8. The image-recording device according to claim 1, wherein the tank further has:

an air-communication port through which the second chamber is open to atmosphere;

a first cylindrical member through which the first chamber is in communication with the second chamber when the tank is in communication with the cartridge, the first cylindrical member having a shifting part configured to be positioned in the second chamber and capable of moving upward; and a second cylindrical member through which the first chamber is in communication with the second chamber when the tank is in communication with the cartridge, wherein the shifting part of the first cylindrical member has a bottom end positioned below the air-communication port, wherein the maximum quantity indicates a volume of the second chamber below the bottom end of the shifting part, and wherein the controller expands the maximum quantity by moving the shifting part of the first cylindrical member upward.

9. The image-recording device according to claim 1, further comprising:

a pump configured to transfer consumable in the cartridge held by the mount body to the tank; and a valve configured to shift between an open state and a closed state, in the open state the valve allowing consumable to be supplied from the first chamber to the second chamber, in the closed state the valve prohibiting supply of consumable from the first chamber to the second chamber, wherein the valve is in the open state when the pump is driven whereas the valve is in the closed state when the pump is stopped, wherein the controller is configured to further perform controlling the pump to drive a first time period so that consumable in the first chamber is supplied to the second chamber in a case where a residual quantity of consumable stored in the second chamber is consumed through a recording operation of the image executed by the recording device and becomes lower than a prescribed value, wherein the expanding is performed by driving the pump a second time period longer than the first time period.

10. The image-recording device according to claim 1, wherein the mount body includes a mounting sensor configured to output different signals depending on whether the cartridge is mounted to the mount body or detached from the mount body, wherein the expanding increases the maximum quantity of consumable from a first maximum quantity to a second maximum quantity larger than the first maximum quantity, and wherein the controller is configured to further perform restoring the maximum quantity of consumable from the second maximum quantity to the first maximum quantity when determining that the cartridge is mounted on the mount body based on a signal outputted from the mounting sensor.

11. The image-recording device according to claim 10, wherein the first maximum quantity depends on a residual amount of consumable, and wherein the second maximum quantity is larger than the first maximum quantity at a time that the specific condition is satisfied.

12. The image-recording device according to claim 1, further comprising an input interface configured to receive a user input, wherein the expanding increases the maximum quantity of consumable from a first maximum quantity to a second maximum quantity larger than the first maximum quantity, and wherein the controller is configured to further perform restoring the maximum quantity of consumable from the second maximum quantity to the first maximum quantity when a user input indicating that the cartridge is replaced is received at the input interface.

13. The image-recording device according to claim 12, wherein the first maximum quantity depends on a residual amount of consumable, and wherein the second maximum quantity is larger than the first maximum quantity at a time that the specific condition is satisfied.

14. An image-recording device comprising:

a mount body configured to detachably hold a cartridge, the cartridge having a first chamber configured to store consumable therein and an outlet;

a tank configured to be in communication with the cartridge when the cartridge is held by the mount body, the tank having a second chamber configured to store consumable and an inlet, and consumable in the first chamber being capable of moving into the second chamber via the outlet of the cartridge and the inlet of the tank;

a recording device configured to record an image using consumable outputted from the second chamber;

a communication interface; and a controller configured to perform:

determining whether a first residual quantity of consumable stored in the first chamber is lower than or equal to a prescribed threshold, the prescribed threshold being no less than zero; and executing an expanding process to expand a maximum quantity of consumable up to which consumable is capable of being stored in the second chamber when a specific condition is satisfied, the specific condition including a first condition that the first residual quantity of consumable stored in the first chamber is higher than the prescribed threshold and a second condition that information notifying that the cartridge is to be replaced is received at the communication interface, wherein a total residual quantity is unchanged before and after the expanding process is executed, the total residual quantity being a sum of the first residual quantity and a second residual quantity of consumable stored in the second chamber, and wherein an expanded maximum quantity to which consumable is capable of being stored in the second chamber after the expanding process is executed is larger than the maximum quantity before the expanding process is executed.

* * * * *